US012607002B2

(12) United States Patent
Chen et al.

(10) Patent No.: US 12,607,002 B2
(45) Date of Patent: Apr. 21, 2026

(54) CLOSESTOOL FLUSHING SYSTEM WITH FLOW INCREASING DEVICE

(71) Applicant: Esmart (Xiamen) Technology Co., Ltd., Xiamen (CN)

(72) Inventors: Haibin Chen, Xiamen (CN); Zhijun Zhong, Xiamen (CN); Fengrong Zhang, Xiamen (CN); Guiyang Huang, Xiamen (CN); Mingfeng Wu, Xiamen (CN); Xinzhao Lai, Xiamen (CN)

(73) Assignee: Esmart (Xiamen) Technology Co., Ltd., Xiamen (CN)

( * ) Notice: Subject to any disclaimer, the term of this patent is extended or adjusted under 35 U.S.C. 154(b) by 119 days.

(21) Appl. No.: 17/798,700

(22) PCT Filed: Mar. 3, 2022

(86) PCT No.: PCT/CN2022/079132
§ 371 (c)(1),
(2) Date: Aug. 10, 2022

(87) PCT Pub. No.: WO2022/267527
PCT Pub. Date: Dec. 29, 2022

(65) Prior Publication Data

US 2025/0101729 A1 Mar. 27, 2025

(30) Foreign Application Priority Data

Jun. 22, 2021 (CN) ..... 202121386668.6
Jun. 22, 2021 (CN) ..... 202121392520.3
(Continued)

(51) Int. Cl.
*E03D 9/16* (2006.01)
*E03D 1/38* (2006.01)

(52) U.S. Cl.
CPC *E03D 9/16* (2013.01); *E03D 1/38* (2013.01)

(58) Field of Classification Search
CPC ..... E03D 1/38; E03D 9/16
(Continued)

(56) References Cited

U.S. PATENT DOCUMENTS 1,998,861 A * 4/1935 Campus ..... E03D 3/04 251/44

FOREIGN PATENT DOCUMENTS

CN 207919689 U 9/2018
CN 207998904 U 10/2018
(Continued)

*Primary Examiner* — Lauren A Crane
(74) *Attorney, Agent, or Firm* — Nitin Kaushik

(57) ABSTRACT

A closestool flushing system comprises a closestool and the flow increasing device, wherein the closestool is provided with a bedpan provided with a water storage cavity in the bottom, the bottom of the bedpan is provided with a water seal, a front cavity wall of the water storage cavity is provided with an injection hole that communicates the water storage cavity with the water seal, and a back cavity wall of the water storage cavity is provided with a mounting hole; the flow increasing device is mounted in the mounting hole and is provided with an injection channel communicated with a pressure water source and a flow increasing channel, a cross-sectional area of an inlet end of which is larger than that of an outlet end of the injection channel.

22 Claims, 22 Drawing Sheets

(30) Foreign Application Priority Data

| | | |
|---|---|---|
| Jun. 22, 2021 | (CN) | 202121395279.X |
| Jul. 16, 2021 | (CN) | 202121619058.6 |
| Oct. 19, 2021 | (CN) | 202122517511.9 |
| Jan. 27, 2022 | (CN) | 202220232054.0 |
| Feb. 25, 2022 | (CN) | 202210181808.9 |

(58) Field of Classification Search
USPC ..... 4/421, 425
See application file for complete search history.

(56) References Cited

FOREIGN PATENT DOCUMENTS

| | | | |
|---|---|---|---|
| CN | 109797824 | A1 | 5/2019 |
| CN | 209924074 | U | 1/2020 |
| CN | 212294942 | U | 1/2021 |
| CN | 215211385 | U | 12/2021 |
| CN | 215802071 | U | 2/2022 |
| CN | 215858069 | U | 2/2022 |
| WO | 2017012480 | A1 | 1/2017 |
| WO | 2017152851 | A1 | 9/2017 |

* cited by examiner

CLOSESTOOL FLUSHING SYSTEM WITH FLOW INCREASING DEVICE

BACKGROUND OF THE INVENTION

1. Technical Field

The present invention relates to the technical field of sanitary ware, particularly to a closestool flushing system with a flow increasing device.

2. Description of Related Art

As for a current closestool flushing structure with an injection hole in the bottom of a bedpan, water of a water supply source is usually directly communicated with the injection hole and is injected toward a drain-off pipeline through the injection hole, so that the drain-off pipeline generates siphoning to realize discharge. However, the closestool of this flushing structure features small flushing force and needs a large water pressure of the water supply source. When the drain-off pipeline of the closestool generates siphoning to siphon off water seal water in the bottom of the bedpan, the pressure water injected from the injection hole will collide with the inner wall surface of the bottom of the bedpan, so as to generate loud flushing noise and splashing phenomenon.

BRIEF SUMMARY OF THE INVENTION

In order to solve the above-mentioned technical problems, the present invention provides a closestool flushing system with a flow increasing device.

In order to achieve the above-mentioned objective, a technical solution used in the present invention is as follows: a closestool flushing system with a flow increasing device includes:

a closestool provided with a bedpan, where the bottom of the bedpan is provided with water seal water for forming a water seal, the bottom of the bedpan is provided with a water storage cavity that is provided with a front cavity wall and a back cavity wall arranged opposite each other, the front cavity wall is provided with an injection hole, a back cavity wall is provided with a mounting hole, and the water storage cavity is communicated with the water seal through the injection hole; and a flow increasing device mounted in the mounting hole, where the flow increasing device is provided with an injection channel and a flow increasing channel, a cross-sectional area of an inlet end of the flow increasing device is larger than that of an outlet end of the injection channel, the inlet end of the injection channel is communicated with a pressure water source that provides pressure water, water at the outlet end of the injection channel is sprayed to the inlet end of the flow increasing channel, a flow increasing gap communicated with the water storage cavity is formed between the outlet end of the injection channel and the inlet end of the flow increasing channel, and water in the flow increasing channel is sprayed to the water seal through the injection hole.

In a preferred embodiment, the flow increasing device includes an outer sleeve for connecting the injection channel with the flow increasing channel, the outlet end of the injection channel and the inlet end of the flow increasing channel are located in the outer sleeve, a side wall of the outer sleeve is provided with a penetrative flow increasing hole, and the flow increasing gap is communicated with the water storage cavity through the flow increasing hole.

In a preferred embodiment, the flow increasing device includes an injection main body and a flow increasing main body connected together through a connecting structure, the injection channel and the outer sleeve both are arranged on the injection main body, and the flow increasing channel is arranged on the flow increasing main body.

In a preferred embodiment, the flow increasing device is hermetically arranged in the mounting hole in a penetrating manner and further includes a first nut, the flow increasing device is provided with a first limiting portion, and an end of the flow increasing device stretching out of the water storage cavity from the mounting hole is in screw joint with the first nut, so that the first limiting portion further presses against an inner side of the back cavity wall or an outer side of the front cavity wall while the first nut presses against an outer side of the back cavity wall.

In a preferred embodiment, the flow increasing device is further hermetically arranged in the injection hole in a penetrating manner, or the flow increasing device is further arranged in the injection hole in a penetrating manner and there is a flow passage gap between the flow increasing device and a hole wall of the injection hole.

In a preferred embodiment, the pressure water source stops supplying water to the flow increasing device prior to decline of a water level of the water storage cavity till the water storage cavity is able to be communicated with an outer atmosphere through the injection hole; and the water storage cavity is provided with an air vent and is communicated with the outer atmosphere through the air vent.

In a preferred embodiment, the pressure water source includes a water tank and a water pump, an inlet of the water pump is communicated with the water tank, an outlet of the water pump is communicated with the inlet end of the injection channel, and the water pump is used for pumping water in the water tank to the flow increasing device; or the pressure water source is municipal tap water, a pipeline between the flow increasing device and the pressure water source is provided with a control valve, and the pressure water source is controlled to be connected with or disconnected with the flow increasing device through the control valve.

In a preferred embodiment, the closestool is provided with a cleaning pipeline for flushing a flushing surface of the bedpan and further includes a switching valve for switching water supply to the cleaning pipeline and the flow increasing device, and an outlet of the water pump is in switching communication with the inlet of the flow increasing device and the cleaning pipeline through the switching valve; the water pump controls the switching valve to be switched to supply water to the flow increasing device after being started and controlling the switching valve to be switched to a water supply preset time of the cleaning pipeline; after the pressure water supply stops water supply to the flow increasing device, the switching valve is re-switched to supply water to the cleaning pipeline so as to supplement water to the water seal.

In a preferred embodiment, the flow increasing device is hermetically matched with the injection hole through a sealing corrugated pad, the sealing corrugated pad is sleeved outside the flow increasing device and is located between the flow increasing device and the hole wall of the injection hole; or the flow increasing device is hermetically matched with the injection hole through a first sealing pad, the first sealing pad is sleeved outside the flow increasing device, and the flow increasing device presses the first sealing pad against the outer side or the inner side of the front cavity wall.

In a preferred embodiment, the bottom of the bedpan is further provided with a first blow-off pipe, an outlet of the flow increasing device is arranged opposite an inlet of the blow-off pipe, and the cross area of the outlet of the flow increasing device is smaller than that of the inlet of the blow-off pipe.

In a preferred embodiment, the flow increasing device is fixedly mounted in the injection hole and is hermetically and fixedly mounted in the mounting hole, the side wall of the flow increasing device is provided with a flow increasing hole communicated with the water storage cavity, and the flow increasing gap is communicated with the water storage cavity through the flow increasing hole.

In a preferred embodiment, the closestool flushing system with a flow increasing device further includes a pre-locking sleeve and a second nut, where the pre-locking sleeve is hermetically fixed in the mounting hole, the flow increasing device is sleeved in the pre-locking sleeve and is hermetically matched with the pre-locking sleeve, and the second nut is in screw joint with an end of the pre-locking sleeve located outside the water storage cavity and presses the flow increasing device against the inner side of the front cavity wall or the pre-locking sleeve.

In a preferred embodiment, the closestool flushing system with a flow increasing device further includes a third nut, where the pre-locking sleeve is arranged in the mounting hole in a penetrating manner and an end of the pre-locking sleeve located in the water storage cavity is provided with a second limiting portion, and the third nut is in screw joint with a portion of the pre-locking sleeve stretching out of the water storage cavity, so that the back cavity wall is clamped between the third nut and the second limiting portion; or, the pre-locking sleeve and the back cavity wall are of an integrated structure.

In a preferred embodiment, a portion of the injection channel close to the outlet end of the injection channel is provided with a first rectifying straight section, a value range of a diameter D1 of the first rectifying straight section is as follows: D1 is greater than or equal to 3 mm but less than or equal to 8 mm, and a ratio of a length L1 of the first rectifying straight section to the diameter D1 thereof is as follows: L1:D1 is greater than or equal to 2.

In a preferred embodiment, a portion of the flow increasing channel close to the outlet end of the flow increasing channel is provided with a second rectifying straight section, a value range of a diameter D2 of the second rectifying straight section is as follows: D2 is greater than or equal to 8 mm but less than or equal to 25 mm, and a ratio of a length L2 of the second rectifying straight section to the diameter D2 thereof is as follows: L2:D2 is greater than or equal to 2.

In a preferred embodiment, a value range of an axial distance H between the outlet end of the injection channel and the inlet end of the flow increasing channel is as follows: H is greater than or equal to 0 but less than or equal to 85 mm.

In a preferred embodiment, the flow increasing device is fixedly mounted in the injection hole through a flexible piece.

In a preferred embodiment, the flexible piece is arranged outside the flow increasing device and is located between the flow increasing device and the hole wall of the injection hole.

In a preferred embodiment, the flexible piece is annular or C-shaped, and is sleeved outside the flow increasing device.

In a preferred embodiment, the flexible piece is made of a PVC material or a rubber material or a nylon material or a gauze material;

the flexible piece is a corrugated pad; or the cross section of the flexible piece is O-shaped; or the cross section of the flexible piece is T-shaped.

In a preferred embodiment, the flow increasing device is hermetically and fixedly mounted in the injection hole and is hermetically matched with the injection hole through the flexible piece, the flexible piece is sleeved outside the flow increasing device and is located between the flow increasing device and the hole wall of the injection hole; or, the flexible piece is in clearance fit with the outer wall of the flow increasing device or is in clearance fit with the hole wall of the injection hole, so that there is a flow passage gap between the outer wall of the flow increasing device and the hole wall of the injection hole.

In a preferred embodiment, the cavity wall of the water storage cavity and the bedpan are of an integrated structure.

In a preferred embodiment, the closestool flushing system with a flow increasing device further includes an anti-odor pipe, where one end of the anti-odor pipe is communicated with the water storage cavity and the other end thereof is communicated with the outer atmosphere, a water lock is formed in the anti-odor pipe, and saved water of the water lock is communicated with water of the water storage cavity and the water seal; when the closestool flushing system flushes, the water storage cavity supplements water to the water seal; and after the closestool flushing system completes flushing, water flowing to the water seal fills the water storage cavity.

In a preferred embodiment, the side wall of the water storage cavity is provided with an air vent, and the anti-odor pipe is communicated with the air vent;

the highest position of the air vent is located below the water level of the water seal; or the highest position of the air vent is located above the water level of the water seal, and the lowest position of the air vent is located below the water level of the water storage cavity.

In a preferred embodiment, the saved water level of the water lock is aligned with that of the water storage cavity; or the saved water level of the water lock is higher than that of the water storage cavity.

In a preferred embodiment, the closestool is provided with a back row type blow-off pipe capable of forming siphoning, an outlet of the back row type blow-off pipe is located on a back portion of the closestool and is arranged backwards, the injection hole is located below the water level of the water seal, an inlet of the back row type blow-off pipe is communicated with the water seal and is located below the water level of the water seal, and the injection hole is arranged opposite the inlet of the back row type blow-off pipe; when the pressure water source provides the pressure water to the flow increasing device, water in the water storage cavity together with the pressure water is sprayed to the inlet of the back row type blow-off pipe through the injection hole under the action of the flow increasing device, so that the back row type blow-off pipe performs siphoning discharge.

In a preferred embodiment, the water storage cavity is provided with an air vent, the air vent is communicated with one end of an anti-odor pipe, the other end of the anti-odor pipe is led to the outer atmosphere, and the water lock is formed on the anti-odor pipe.

Compared with the prior art, the present invention has the following beneficial effects:

1. According to the present invention, by forming a water storage cavity in the bottom of the bedpan and then arranging a flow increasing device in the water storage cavity, water in the water storage cavity is siphoned off into the flow increasing device through a flow increasing gap by means of a Venturi principle, water siphoned off into the flow increasing device together with water injected by the injection channel is injected to a water seal in the bottom of the bedpan from the injection hole through the injection channel, and the flow increasing device has a better flow increasing effect and flow increasing stability, so that water in the water storage cavity is capable of flowing stably to the water seal in the bottom of the bedpan as soon as possible so as to supplement water to the water seal, and therefore, the flushing performance of the closestool is improved, the lowest using pressure of a current pressure type flushing system can be reduced, the noise of the closestool can be reduced, and a splashing phenomenon can be avoided.
2. According to the present invention, as the pressure water source is controlled to stop supplying water to the flow increasing device prior to decline of the water level of the water storage cavity till the water storage cavity is able to be communicated with the outer atmosphere through the injection hole (i.e., prior to decline of the water level of the water storage cavity till the water storage cavity is able to be directly communicated with air in the bottom of the bedpan through the injection hole), so that air in the water storage cavity cannot be directly communicated with the air in the bottom of the bedpan through the injection hole, the air in the water storage cavity can be prevented from being siphoned off into the injection hole, a gas-liquid mixing phenomenon and a dry spray phenomenon are further avoided, and therefore, the noise of a water flow sprayed through the injection hole is effectively reduced.
3. The flow increasing device of the present invention is fixedly mounted in the injection hole and is hermetically and fixedly mounted in the mounting hole, the side wall of the flow increasing device is provided with a flow increasing hole communicated with the water storage cavity, and the flow increasing gap is communicated with the water storage cavity through the flow increasing hole. As the flow increasing device is fixedly mounted in the injection hole and the mounting hole at the same time, the flow increasing device is mounted and positioned more reliably, thereby ensuring that the angle of the injected water flow is not deviated, and the flushing effect is more stable.
4. On the one hand, it is often needed to prick the injection hole and the mounting hole manually, and on the other hand, the closestool has deformation of a certain degree usually during firing. Therefore, it is difficult to require high coaxiality of the two holes. The flow increasing device of the present invention is fixedly mounted in the injection hole through the flexible piece, so that not only the mounting angle of the flow increasing device can be guaranteed, but also the requirement on the coaxiality of the injection hole and the mounting hole is reduced. Therefore, the closestool of the present invention is easy to manufacture and mold, the yield of products is improved, and the production cost is lowered.
5. By arranging the anti-odor pipe, one end of the anti-odor pipe is communicated with the water storage cavity and the other end thereof is communicated with the atmosphere, the water lock is formed in the anti-odor pipe, and saved water of the water lock is respectively communicated with water of the water storage cavity and the water seal, so that odors can be effectively prevented from being discharged from the water storage cavity to indoors through the water lock, and thus, the user experience is improved.

Figure 1:
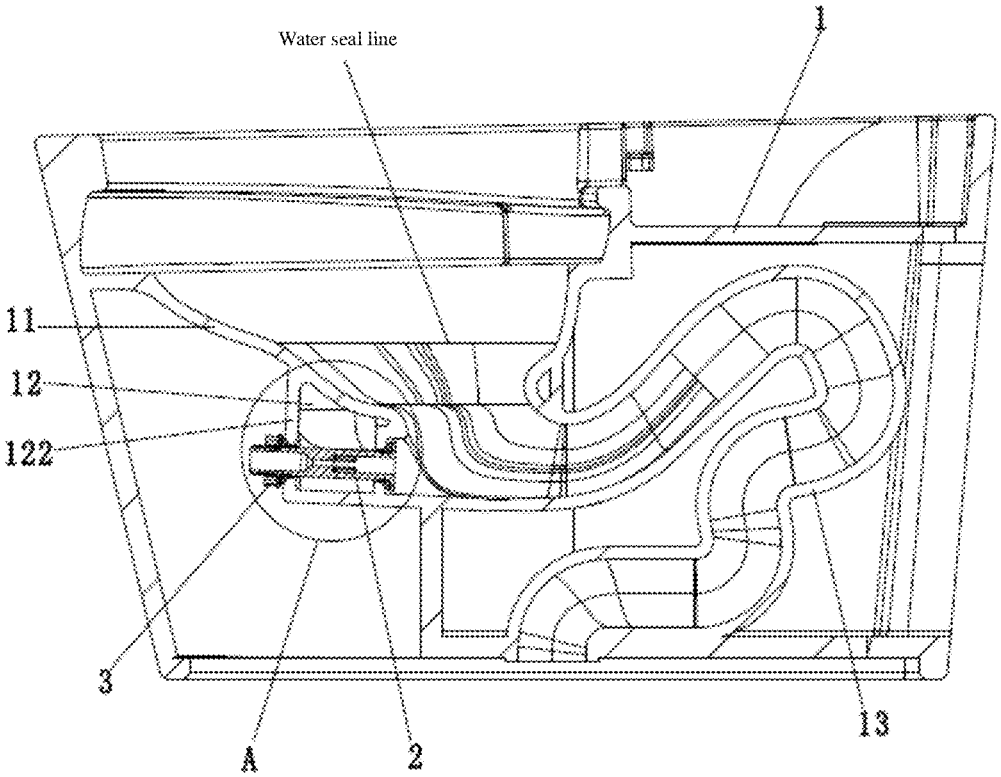
FIG. 1 is a section view of an embodiment I of the present invention.

Reference numerals are illustrated as follows:

1—closestool; 11—bedpan; 12—water storage cavity; 121—front cavity wall; 1211—injection hole; 122—back cavity wall; 1222—mounting hole; 123—air vent; 13—blow-off pipe; 131—inlet of back row type blow-pipe; 132—outlet of back row type blow-pipe; 14—water seal; 2—flow increasing device; 21—injection channel; 22—flow increasing channel; 23—flow increasing gap; 24—flow increasing hole; 25—first limiting portion; 26—outer sleeve; 27—injection main body; 28—flow increasing main body; 3—first nut; 4—first sealing pad; 5—second sealing pad; 6—prelocking sleeve; 61—second limiting portion; 7—second nut; 8—third nut; 9—third sealing pad; 10—flexible piece; 20—anti-odor pipe; 201—water lock; 30—water tank; 40—water pump; 50—flushing pipeline; 60—switching valve; 70—main flushing pipeline; 80—flushing nozzle assembly;

a-highest point position of bottom wall of reversed U-shaped or reversed V-shaped pipe section;

b-highest point position of inlet of back row type blow-off pipe.

DETAILED DESCRIPTION OF THE INVENTION

Further description of the present invention in detail will be made below in combination with accompanying drawings and embodiments but a closestool flushing system with a flow increasing device provided by the present invention is not limited to the embodiments.

Embodiment I

Referring to FIG. 1 to FIG. 5, a closestool flushing system with a flow increasing device provided by the embodiment of the present invention includes:

a closestool 1, the closestool 1 being provided with a bedpan 11, where the bottom of the bedpan 11 is provided with water seal water for forming a water seal (not shown in FIGS.), the bottom of the bedpan 11 is provided with a water storage cavity 12 (or called as "water seal water storage cavity", "cavity" and "flow increasing water tank", same in other embodiments), the water storage cavity 12 is provided with a front cavity wall 121 and a back cavity wall 122 arranged opposite each other, the front cavity wall 121 is provided with an injection hole 1211 (or called as "front mounting hole", same in other embodiments), a back cavity wall 122 is provided with a mounting hole 1222 (or called as "back mounting hole", same in other embodiments), and the water storage cavity 12 is communicated with the water seal (not shown in FIGS.) in the bottom of the bedpan 11 through the injection hole 1211; and a flow increasing device 2 (or called as "Venturi flow increasing device", "nozzle" and "injection pump", same in other embodiments), the flow increasing device 2 being hermetically mounted in the mounting hole 1222 (i.e., the flow increasing device 2 is hermetically and fixedly mounted in the mounting hole 1222) in a penetrating manner, where the flow increasing device 2 is provided with an injection channel 21 and a flow increasing channel 22, a cross-sectional area of an inlet end of the flow increasing channel 22 is larger than that of an outlet end of the injection channel 21, the inlet end of the injection channel 21 is communicated with a pressure water source (not shown in FIGS.) that provides pressure water, water at the outlet end of the injection channel 21 is sprayed to the inlet end of the flow increasing channel 22, a flow increasing gap 23 communicated with the water storage cavity 12 is formed between the outlet end of the injection channel 21 and the inlet end of the flow increasing channel 22 and water in the flow increasing channel 22 is sprayed to the water seal in the bottom of the bedpan 11 through the injection hole 1211.

Specifically, in the embodiment, a side wall of the flow increasing device 2 is provided with a flow increasing hole 24 (or called as "through-flow hole", same in other embodiments), and the flow increasing gap 23 is communicated with the water storage cavity 12 through the flow increasing hole 24; the water storage cavity 12 is formed in a back surface of the bottom of the bedpan 11, the water storage cavity 12 is integrally formed on the bedpan 11, and most space of the water storage cavity 12 is below a water seal line in the bottom of the bedpan 11, so that more water is stored in a small space. Of course, the water storage cavity 12 can also be independently formed relative to the bedpan 11. In the embodiment, a position of the water storage cavity 12 close to its top is further provided with an air vent 123 (or called as "vent", same in other embodiments), and the water storage cavity 12 is communicated with an outer atmosphere through the air vent 123; in a normal state, the water level of the water storage cavity 12 is aligned with that of the water seal in the bottom of the bedpan 11; the pressure water source is specifically municipal tap water or a water pump and the like; when the closestool flushing system flushes, the water storage cavity 12 supplements water to the water seal; and after the closestool flushing system completes flushing, water flowing to the water seal in the bottom of the bedpan 11 fills the water storage cavity 12. Preferably, the cross-sectional area of the whole flow increasing channel 22 is larger than that of the outlet end of the injection channel 21.

Figure 2:
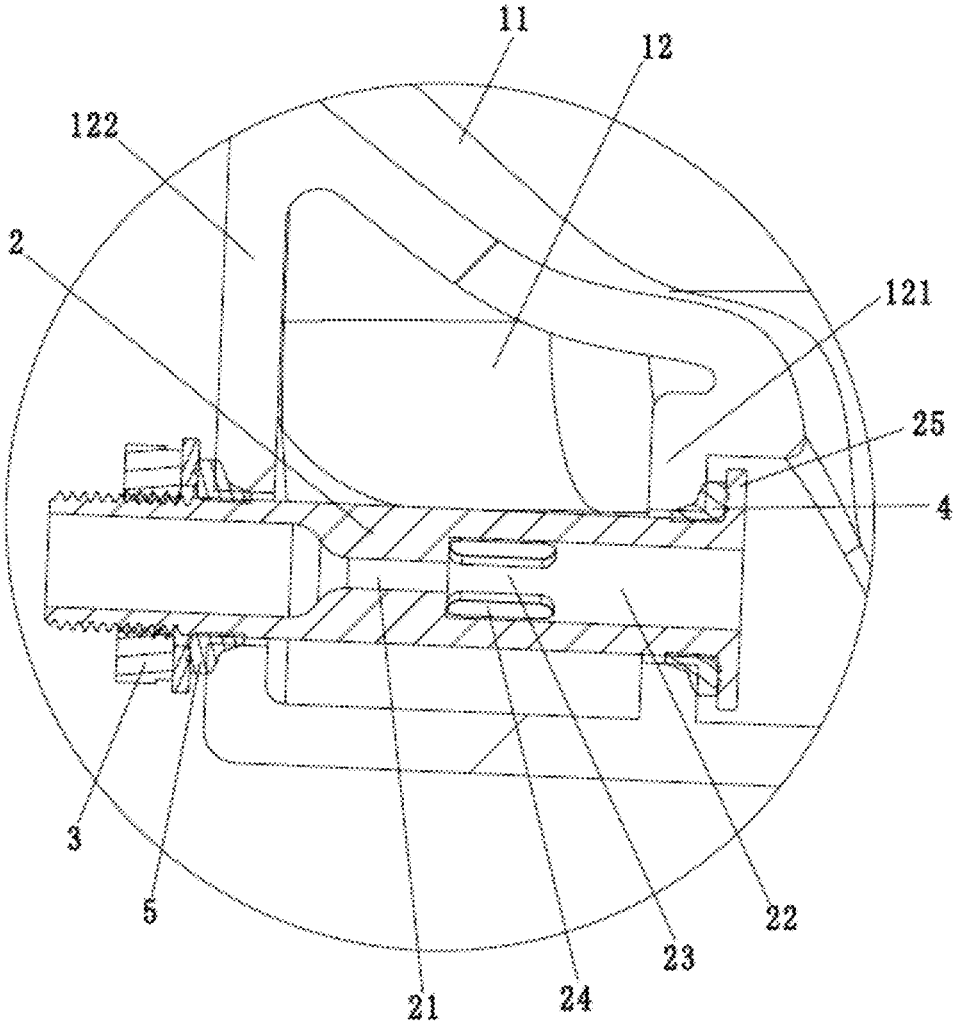
FIG. 2 is a partial enlarged schematic diagram of A in FIG. 1.
Figure 5:
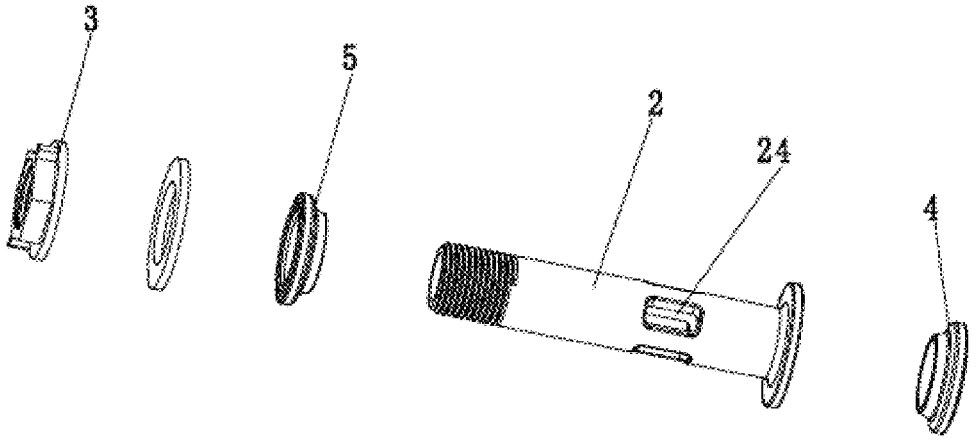
FIG. 5 is a schematic diagram of a breakdown structure of a flow increasing device, a first nut, a first sealing pad and a second sealing pad of an embodiment I of the present invention.
Figure 6:
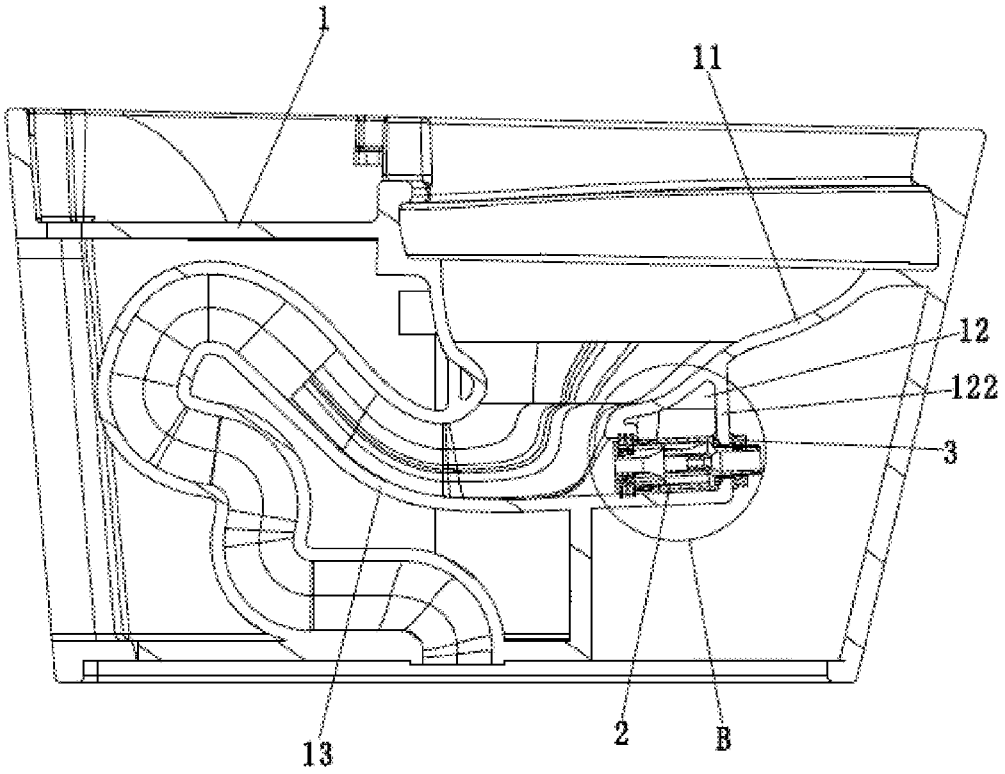
FIG. 6 is a section view of an embodiment II of the present invention.
Figure 7:
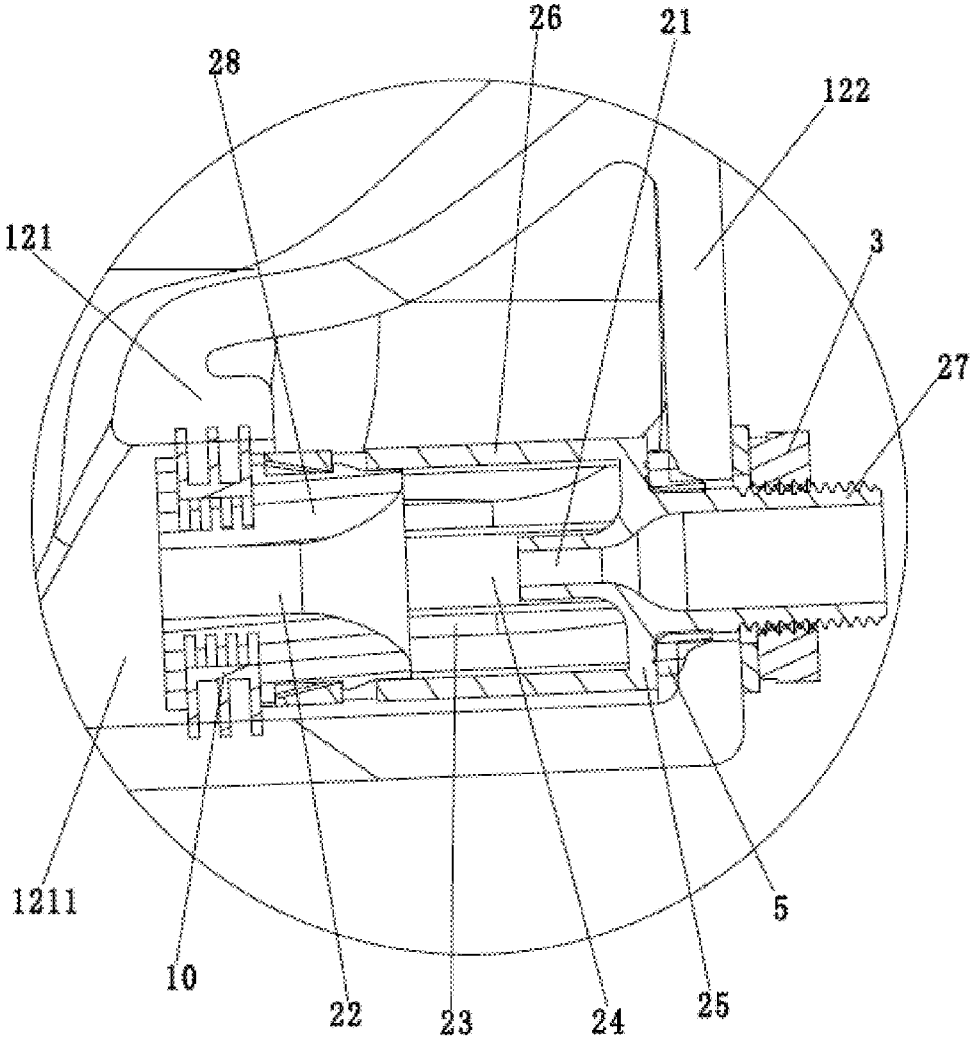
FIG. 7 is a partial enlarged schematic diagram of B in FIG. 6.
Figure 8:
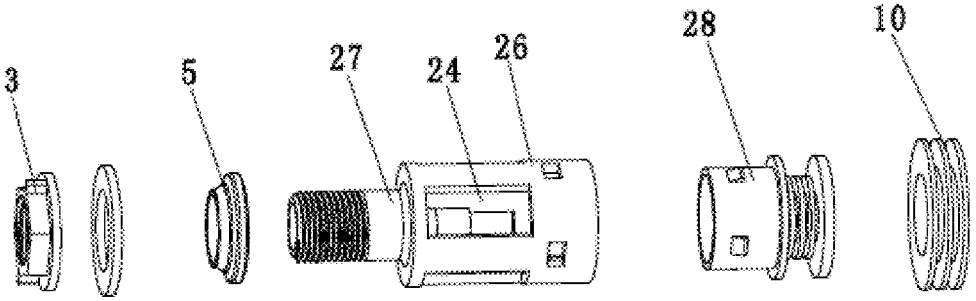
FIG. 8 is a schematic diagram of a breakdown structure of an injection main body, a flow increasing device, a first nut, a sealing corrugated pad and a second sealing pad of an embodiment II of the present invention.
Figure 9:
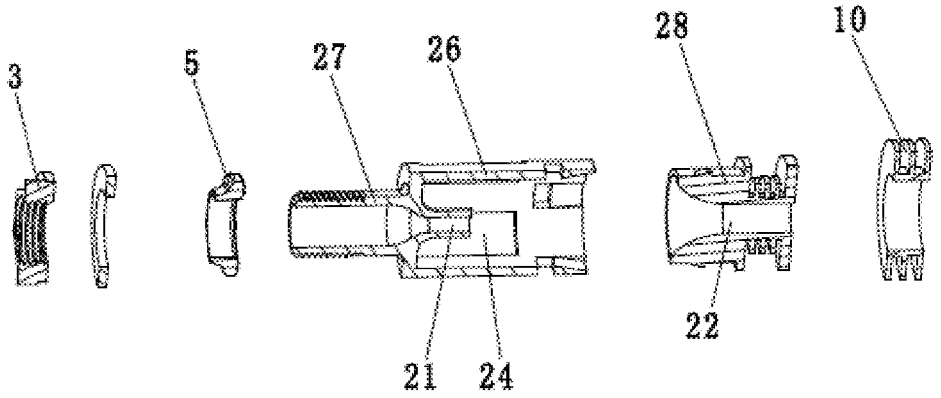
FIG. 9 is a section view of an injection main body, a flow increasing device, a first nut, a sealing corrugated pad and a second sealing pad disassembled of an embodiment II of the present invention.

Referring to FIG. 1, FIG. 2 and FIG. 5, in the embodiment, the closestool flushing system with a flow increasing device further includes a first nut 3, where the flow increasing device 2 is provided with a first limiting portion 25, and an end of the flow increasing device 2 stretching out of the water storage cavity 12 from the mounting hole 1222 is in screw joint with the first nut 3, so that the first limiting portion 25 further presses against an outer side of the front cavity wall 121 while the first nut 3 presses against an outer side of the back cavity wall 122, so as to fix the flow increasing device 2. During mounting, the flow increasing device 2 successively passes through the injection hole 1211 and the mounting hole 1222 from the bottom of the bedpan 11, and then the end of the flow increasing device 2 stretching out from the mounting hole 1222 to the water storage cavity 12 is in screw joint with the first nut 3, so as to fix the flow increasing device 2.

Referring to FIG. 1, FIG. 2 and FIG. 5, in the embodiment, the flow increasing device 2 is fixedly mounted in the injection hole 1211. As the flow increasing device 2 is fixedly mounted in the injection hole 1211 and the mounting hole 1222 at the same time, the flow increasing device 2 is mounted and positioned more reliably, thereby ensuring that the angle of the injected water flow is not deviated, and the flushing effect is more stable. Specifically, in the embodiment, the flow increasing device 2 is hermetically arranged in the injection hole 1211 in a penetrating manner (i.e., the flow increasing device 2 is hermetically and fixedly arranged in the injection hole 1211), so that not only water in the water storage cavity 12 can be better sprayed to the water seal in the bottom of the bedpan 11 through the injection hole 1211, but also the flow increasing device 2 can be better mounted and fixed, and meanwhile, it is beneficial to preventing dirt in the water seal from entering the water storage cavity 12 from the gap between the injection hole 1211 and the flow increasing device 2; the flow increasing device 2 is hermetically matched with the injection hole 1211 through the first sealing pad 4, the first sealing pad 4 is sleeved outside the flow increasing device 2, and the first limiting portion 25 of the flow increasing device 2 presses the first sealing pad 4 against the outer side of the front cavity wall 121; the flow increasing device 2 is further hermetically matched with the mounting hole 1222 through the second sealing pad 5, the second sealing pad 5 is sleeved outside the flow increasing device 2, and the first nut 3 presses the second sealing pad 5 against the outer side of the back cavity wall 122.

Figure 3:
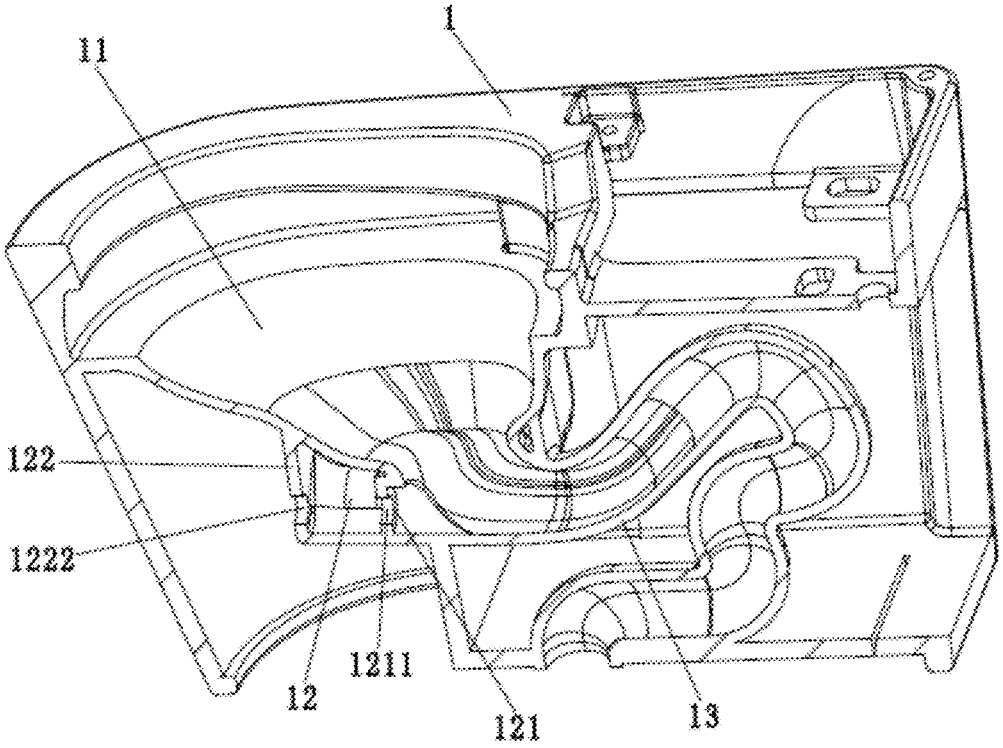
FIG. 3 is a section view I of a closestool of an embodiment I of the present invention.
Figure 4:
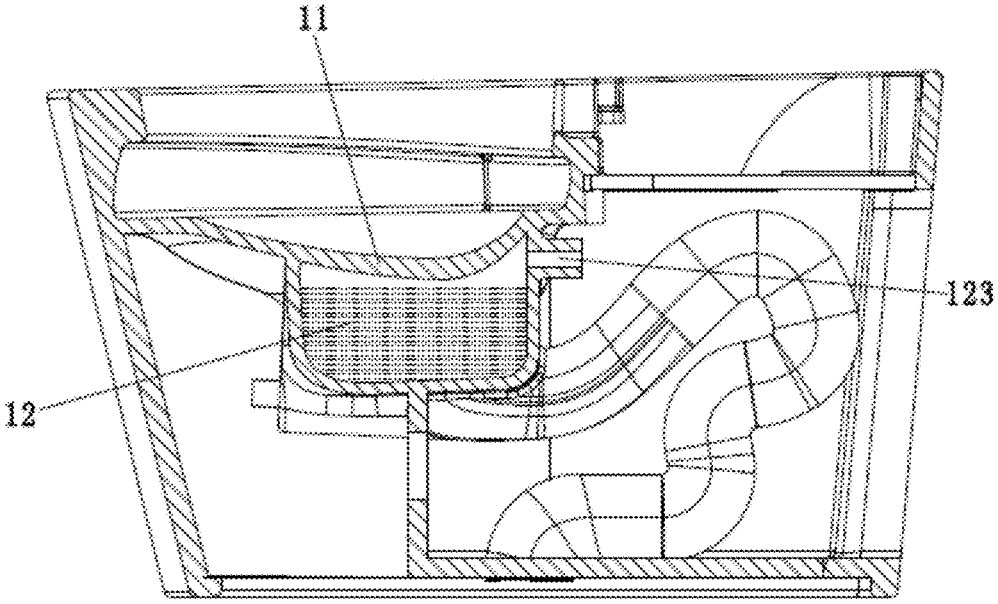
FIG. 4 is a section view II of a closestool of an embodiment I of the present invention.

Referring to FIG. 1, FIG. 3 and FIG. 4, in the embodiment, the bottom of the bedpan 11 is further provided with a blow-off pipe 13 capable of forming siphoning. In a normal state, the injection hole 1211 is located below the water level of the water seal, and the inlet of the blow-off pipe 13 is communicated with the water seal and is located below the water level of the water seal; the outlet of the flow increasing device 2 (i.e., the outlet of the flow increasing channel 22) is arranged opposite the blow-off pipe 13, and the cross-sectional area of the outlet of the flow increasing device 2 is smaller than that of the inlet of the blow-off pipe 13, so that water in the flow increasing channel 22 is sprayed towards the inlet of the blow-off pipe 13, the closestool 1 generates siphoning through Venturi effect, and thus, the siphoning strength is larger as a result of Venturi effect twice. The blow-off pipe 13 in the embodiment is specifically a ground row type blow-off pipe, and an outlet of the ground row type blow-off pipe faces downwards and is communicated with a sewage pipeline (not shown in FIGS.) on the ground.

In the embodiment, the closestool flushing system is not provided with a water tank (not shown in FIGS.), a working liquid level of which is higher than that of the water seal.

The working principle of the embodiment is briefly described as follows:

During flushing, the pressure water is sprayed to the flow increasing channel 22 from the injection channel 21 to generate a negative pressure at the flow increasing gap 23, so that the water in the water storage cavity 12 is siphoned off into the flow increasing gap 23 through the flow increasing hole 24. The water siphoned off into the flow increasing gap 23 together with the water sprayed from the injection channel 21 is sprayed through the flow increasing channel 22, and the flow increasing channel 22 sprays water toward the inlet of the blow-off pipe 13 to generate the negative pressure at the inlet of the blow-off pipe 13 so as to siphon water in the water seal in the bottom of the bedpan 11 off into the inlet of the blow-off pipe 13. The water siphoned off into the inlet of the blow-off pipe 13 in the water seal together with the water sprayed by the flow increasing channel 22 is discharged from the blow-off pipe 13. As a result of further flow increase and amplification, a full-pipe-like state needed by siphoning is achieved rapidly in the blow-off pipe 13 and the blow-off pipe 13 generates siphoning rapidly, and discharges dirt out of the closestool 1 rapidly under a thrust of the flow increasing device 2 and a siphoning force of the blow-off pipe 13.

In other embodiments, it can further be structured that the flow increasing device is further arranged in the injection hole in a penetrating manner and there is a flow passage gap between the flow increasing device and the hole wall of the injection hole. The flow passage gap is preferably smaller than 2 mm. In the gap range, similarly, the water in the water storage cavity can also be better sprayed to the water seal in the bottom of the bedpan through the injection hole, the flow increasing device can be better mounted and fixed, and meanwhile, dirt in the water seal can further be better prevented from entering the water storage cavity from the flow passage gap between the hole wall of the injection hole and the flow increasing device.

In other embodiments, the first limiting portion of the flow increasing device can also alternatively press the first sealing pad against the inner side of the front cavity wall.

Embodiment II

The embodiment is substantially the same as the embodiment, and the difference thereof is as follows:

Referring to FIG. 6 to FIG. 10, in the embodiment, the flow increasing device 2 includes an outer sleeve 26 for connecting an injection channel 21 and a flow increasing channel 22, where an outlet end of the injection channel 21 and an inlet end of the flow increasing channel 22 are located in the outer sleeve 26, a side wall of the outer sleeve 26 is provided with a perforative flow increasing hole 24, and a flow increasing gap 23 is communicated with a water storage cavity 12 through the flow increasing hole 24. Preferably, a cross-sectional area of the inlet end of the flow increasing channel 22 is gradually decreased along a direction away from the flow increasing gap 23. In the embodiment, pressure water is sprayed to the flow increasing channel 22 from the injection channel 21 to generate a negative pressure at the flow increasing gap 23, so that water in the water storage cavity 12 is siphoned off into the flow increasing gap 23 through the flow increasing hole 24, water siphoned off into the flow increasing gap 23 together with water sprayed from the injection channel 21 is sprayed through the flow increasing channel 22, and the water sprayed from the injection channel 21 and the water siphoned off into the flow increasing channel 23 can be better gathered and guided due to a structural design of the inlet end of the flow increasing channel 22, thereby increasing the flushing force of the water sprayed from the flow increasing channel 22.

Specifically, in the embodiment, the flow increasing device 2 includes an injection main body 27 and a flow increasing main body 28 connected together through a connecting structure, the injection channel 21 and the outer sleeve 26 both are arranged on the injection main body 27, the flow increasing channel 22 is arranged on the flow increasing main body 28, and the flow increasing device 2 of the structural design is easy to produce and manufacture, and the production cost is lowered. The inlet end of the flow increasing channel 22 is specifically horn-shaped. The connecting structure for connecting the injection main body 27 and the flow increasing main body 28 can specifically be of a threaded connection structure or a snap joint connection structure in the prior art.

Figure 10:
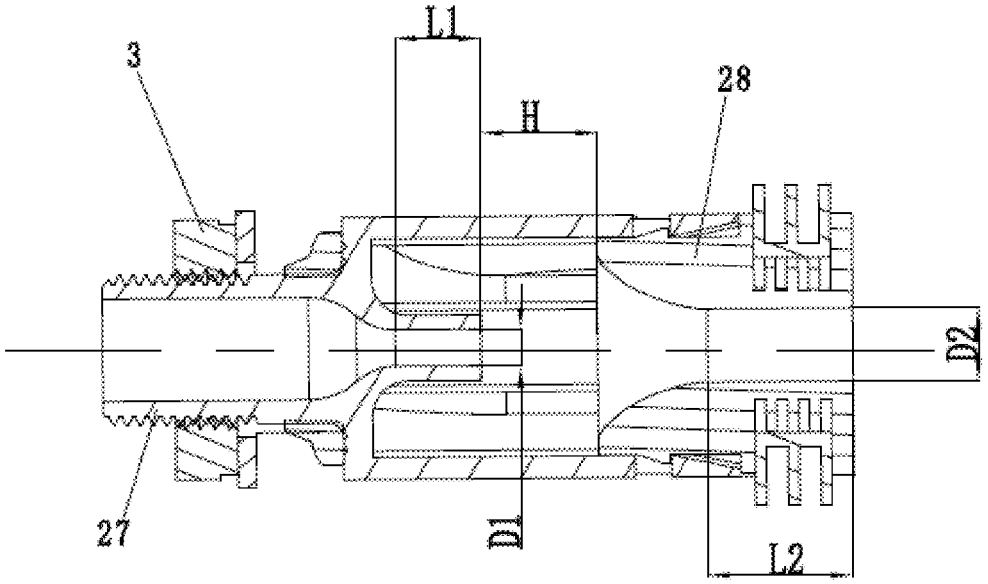
FIG. 10 is a section view of an injection main body, a flow increasing device, a first nut, a sealing corrugated pad and a second sealing pad assembled of an embodiment II of the present invention.
Figure 11:
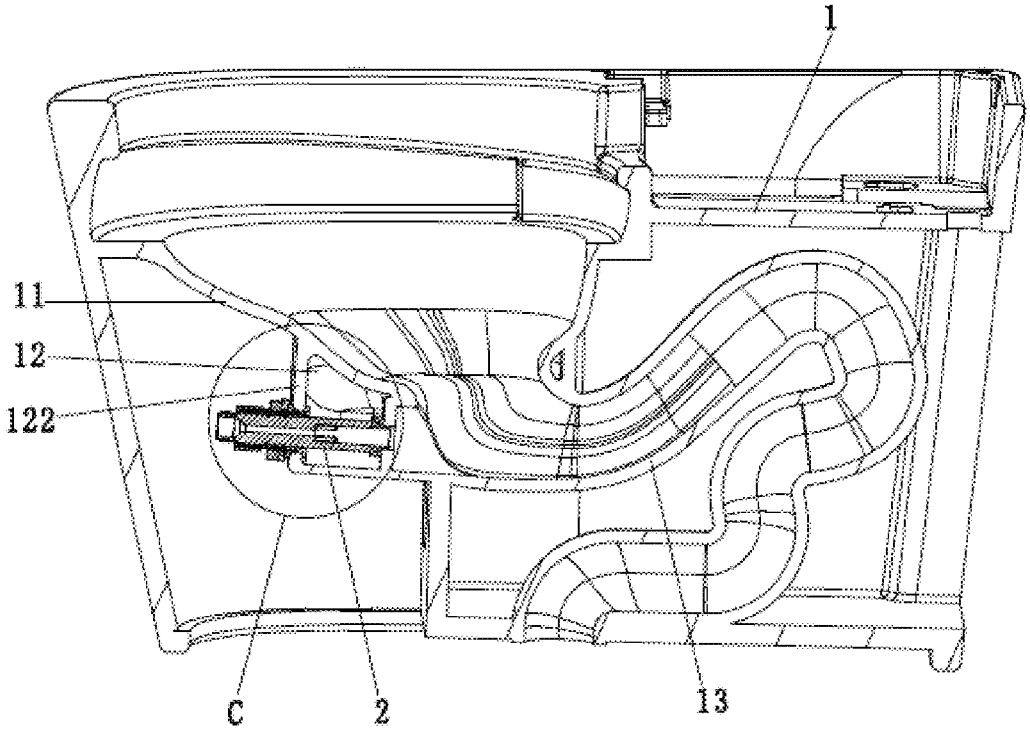
FIG. 11 is a section view of an embodiment III of the present invention.
Figure 12:
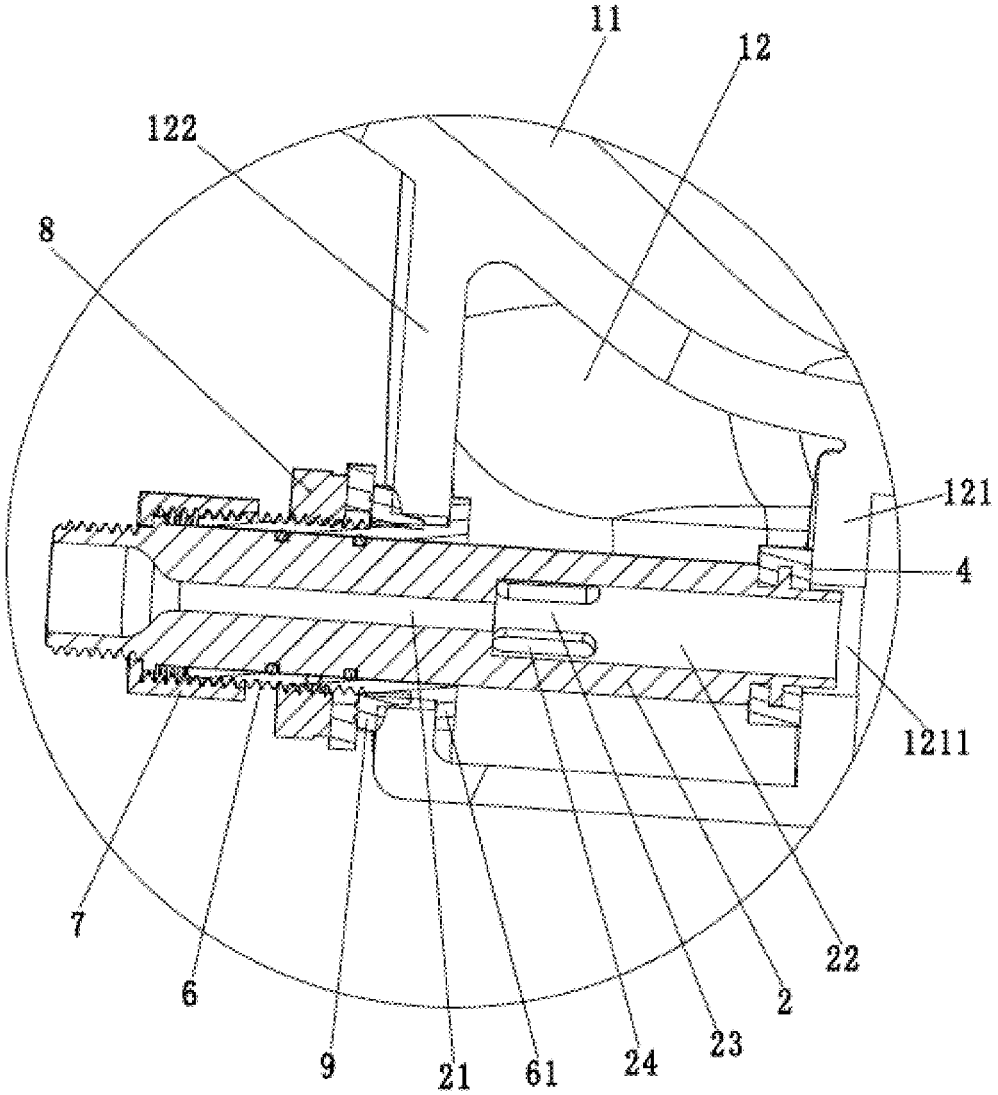
FIG. 12 is a partial enlarged schematic diagram of C in FIG. 11.
Figure 13:
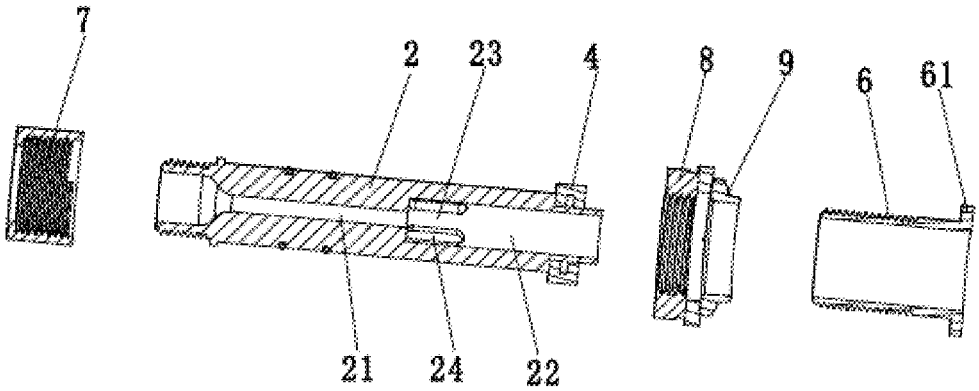
FIG. 13 is a schematic diagram of a breakdown structure of a flow increasing device, a pre-locking sleeve, a second nut and a third nut of an embodiment III of the present invention.
Figure 14:
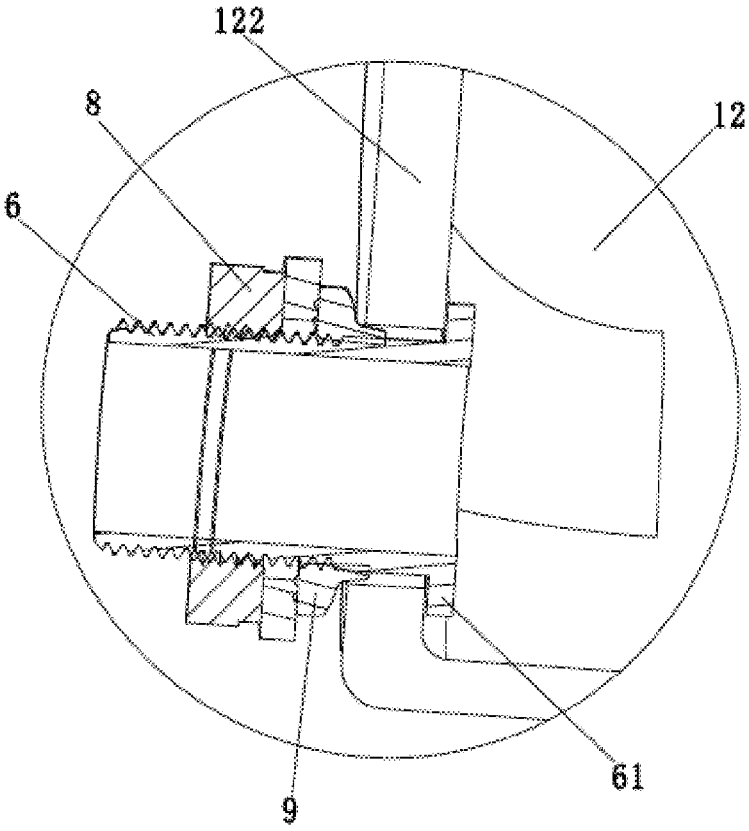
FIG. 14 is a schematic diagram of a pre-locking sleeve and a third nut matched with a back cavity wall in an embodiment III of the present invention.

Referring to FIG. 10, in the embodiment, a portion of the injection channel 21 close to the outlet end of the injection channel 21 is provided with a first rectifying straight section, a value range of a diameter D1 of the first rectifying straight section is as follows: D1 is greater than or equal to 3 mm but less than or equal to 8 mm, preferably D1=3.5 mm or 4 mm or 4.5 mm or 5 mm or 5.5 mm or 6 mm or 6.5 mm or 7 mm or 7.5 mm and the like, specifically; a ratio of a length L1 of the first rectifying straight section to the diameter D1 thereof is as follows: L1:D1 is greater than or equal to 2, preferably L1:D1=3 or 4 or 5 and the like, specifically; a portion of the flow increasing channel 22 close to the outlet end of the flow increasing channel 22 is provided with a second rectifying straight section, a value range of a diameter D2 of the second rectifying straight section is as follows: D2 is greater than or equal to 8 mm but less than or equal to 25 mm, preferably D2=10 mm or 12 mm or 14 mm or 16 mm or 18 mm or 20 mm or 22 mm or 24 mm and the like, specifically; a ratio of a length L2 of the second rectifying straight section to the diameter D2 thereof is as follows: L2:D2 is greater than or equal to 2, preferably L2:D2=3 or 4 or 5 and the like, specifically; a value range of an axial distance H between the outlet end of the injection channel 21 and the inlet end of the flow increasing channel 22 is as follows: H is greater than or equal to 0 but less than or equal to 85 mm, preferably H=5-60 mm specifically, and further preferably H=10-20 mm. By using the above-mentioned numerical range in the embodiment, the injection flow increasing effect of the flow increasing device 2 is better, and water in the water storage cavity 12 can be brought out more stably, so that the water sprayed by the flow increasing device 2 is larger in kinetic energy.

In the embodiment, referring to FIG. 6 to FIG. 10, an end of the flow increasing device 2 stretching out of the water storage cavity 12 from the mounting hole 1222 is in screw joint with the first nut 3, so that the first limiting portion 25 further presses against an outer side of the back cavity wall 122 while the first nut 3 presses against an outer side of the back cavity wall 122, so as to fix the flow increasing device 2. The second sealing pad 5 is sleeved outside the flow increasing device 2, so that the first limiting portion 25 presses the second sealing pad 5 against the inner side of the back cavity wall 122, and therefore, the flow increasing device 2 is hermetically matched with the mounting hole 1222 through the second sealing pad 5.

In the embodiment, there is no first sealing pad as shown in the embodiment I. Referring to FIG. 6 to FIG. 10, in the embodiment, the flow increasing device 2 is fixedly mounted in a injection hole 1211 through a flexible piece 10. On the one hand, it is often needed to prick the injection hole 1211 and the mounting hole 1222 manually, and on the other hand, the closestool 1 has deformation of a certain degree usually during firing. Therefore, it is difficult to require high coaxiality of the two holes. The flow increasing device 2 in the embodiment is fixedly mounted in the injection hole 1211 through the flexible piece 10, so that not only the mounting angle of the flow increasing device 2 can be guaranteed, but also the requirement on the coaxiality of the injection hole 1211 and the mounting hole 1222 is reduced. Therefore, the closestool 1 in the embodiment is easy to manufacture and mold, the yield of products is improved, and the production cost is lowered.

Referring to FIG. 6 to FIG. 10, in the embodiment, the flexible piece 10 is arranged outside the flow increasing device 2 and is located between the flow increasing device 2 and the hole wall of the injection hole 1211. Specifically, in the embodiment, the flexible piece 10 is annular, the flexible piece 10 is sleeved outside the flow increasing device 2, and the flexible piece 10 uses the structural design, so that it is convenient to mount and position the flow increasing device 2 rapidly. In the embodiment, the flexible piece 10 is specifically ring-shaped. Of course, in other embodiments, the flexible piece 10 can further be C-shaped, the flexible piece 10 is sleeved outside the flow increasing device 2 and is located between the flow increasing device 2 and the hole wall of the injection hole 1211, so that it is also convenient to mount and position the flow increasing device 2 rapidly.

Referring to FIG. 6 to FIG. 10, in the embodiment, the flow increasing device 2 is hermetically and fixedly mounted in the injection hole 1211, the flow increasing device 2 is hermetically matched with the injection hole 1211 through the flexible piece 10, the flexible piece 10 is sleeved outside the flow increasing device 2 and is located between the flow increasing device 2 and the hole wall of the injection hole 1211, and the flow increasing device 2 is flexibly and hermetically matched with the injection hole 1211 through the flexible piece 10, so that not only can water in the water storage cavity 12 be better sprayed to the water seal in the bottom of the bedpan 11 through the flow increasing hole 24 and the injection hole 1211 successively, but also dirt in the water seal can be effectively prevented from entering the water storage cavity 12. In the embodiment, as the injection hole 1211 and the mounting hole 1222 have different requirements on sealing effect, and the mounting hole 1222 has a higher requirement on sealing effect, the flow increasing device 2 in the embodiment is in rigid hermetic match with the mounting hole 1222 through the second sealing pad 5 and is in flexible hermetic match with the injection hole 1211 through the flexible piece 10, thereby meeting the requirement on sealing effect in mounting the flow increasing device 2.

Specifically, in the embodiment, the flexible piece 10 is a corrugated gap, specifically a hermetic corrugated pad. The flow increasing device 2 in the embodiment is in flexible hermetic match with the injection hole 1211 through the hermetic corrugated pad, so that the low increasing device 2 is hermetically and fixedly mounted in the injection hole 1211. The flexible piece 10 in the embodiment is made of a rubber material.

In the embodiment, structures and principles of other undescribed parts are consistent with those of the embodiment I, which is no longer described in detail here.

In other embodiments, the flexible piece can further be made of a PVC (polyvinyl chloride) material or a nylon material or a gauze material.

In other embodiments, it can further be structured that the flexible piece is in clearance fit with the outer wall of the flow increasing device, or the flexible piece is in clearance fit with the hole wall of the injection hole, so that there is a flow passage gap between the outer wall of the flow increasing device and the hole wall of the injection hole. In the embodiment, the flexible piece is specifically a C-shaped flexible piece, the flexible piece is sleeved outside the flow increasing device and is located between the flow increasing device and the hole wall of the injection hole, and the flow passage gap is formed between the flow increasing device and the hole wall of the injection hole due to a notch of the C-shaped flexible piece.

Embodiment III

The embodiment is substantially the same as the embodiment I, and the difference thereof is as follows:

In the embodiment, the first nut, the first limiting portion and the second sealing pad as shown in embodiment I are not arranged. Referring to FIG. 11 to FIG. 14, in the embodiment, the embodiment further includes a pre-locking sleeve 6 and a second nut 7, where the pre-locking sleeve 6 is hermetically fixed in the mounting hole 1222, the flow increasing device 2 is sleeved in the pre-locking sleeve 6 and is hermetically matched with the pre-locking sleeve 6, and the second nut 7 is in screw joint with an end of the pre-locking sleeve 6 located outside the water storage cavity 12 and presses the flow increasing device 2 against the inner side of the front cavity wall 121 so as to fix the flow increasing device 2. Specifically, referring to FIG. 11 and FIG. 12, in the embodiment, the flow increasing device 2 is externally provided with a seal ring (not marked in FIGS.) in a sleeving manner, and the flow increasing device 2 is hermetically matched with the pre-locking sleeve 6 through the seal ring. The flow increasing device 2 in the embodiment presses the first sealing pad 4 against the inner side of the front cavity wall 121, so that the flow increasing device 2 is hermetically matched with the injection hole 1211 through the first sealing pad 4. Of course, in other embodiments, the second nut can further press the flow increasing device against the pre-locking sleeve, so as to fix the flow increasing device as well.

Referring to FIG. 11 to FIG. 14, in the embodiment, the closestool flushing system with a flow increasing device further includes a third nut 8, where the pre-locking sleeve 6 is arranged in the mounting hole 1222 in a penetrating manner and an end of the pre-locking sleeve 6 located in the water storage cavity 12 is provided with a second limiting portion 61, and the third nut 8 is in screw joint with a portion of the pre-locking sleeve 6 stretching out of the water storage cavity 12, so that the back cavity wall 122 is clamped between the third nut 8 and the second limiting portion 61, so that the pre-locking sleeve 6 is fixed in the mounting hole 1222. Specifically, the pre-locking sleeve 6 in the embodiment is externally provided with a third sealing pad 9 in a sleeving manner, the third nut 8 presses the third sealing pad 9 against the back cavity wall 122, so as to seal the pre-locking sleeve 6 and the mounting hole 1222. Of course, in other embodiments, it can further be structured that the pre-locking sleeve and the back cavity wall are of an integrated structure.

In the embodiment, structures and principles of other undescribed parts are consistent with those of the embodiment II, which is no longer described in detail here.

Embodiment IV

Figure 15:
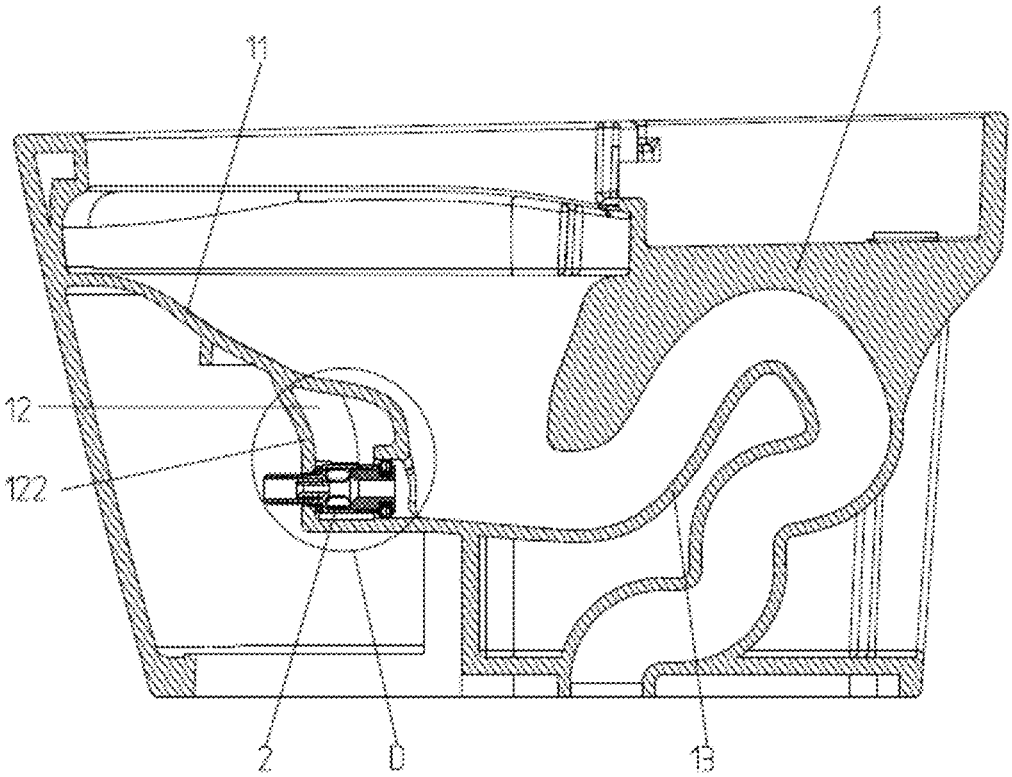
FIG. 15 is a section view of an embodiment IV of the present invention (a first nut is hidden in FIG.).
Figure 16:
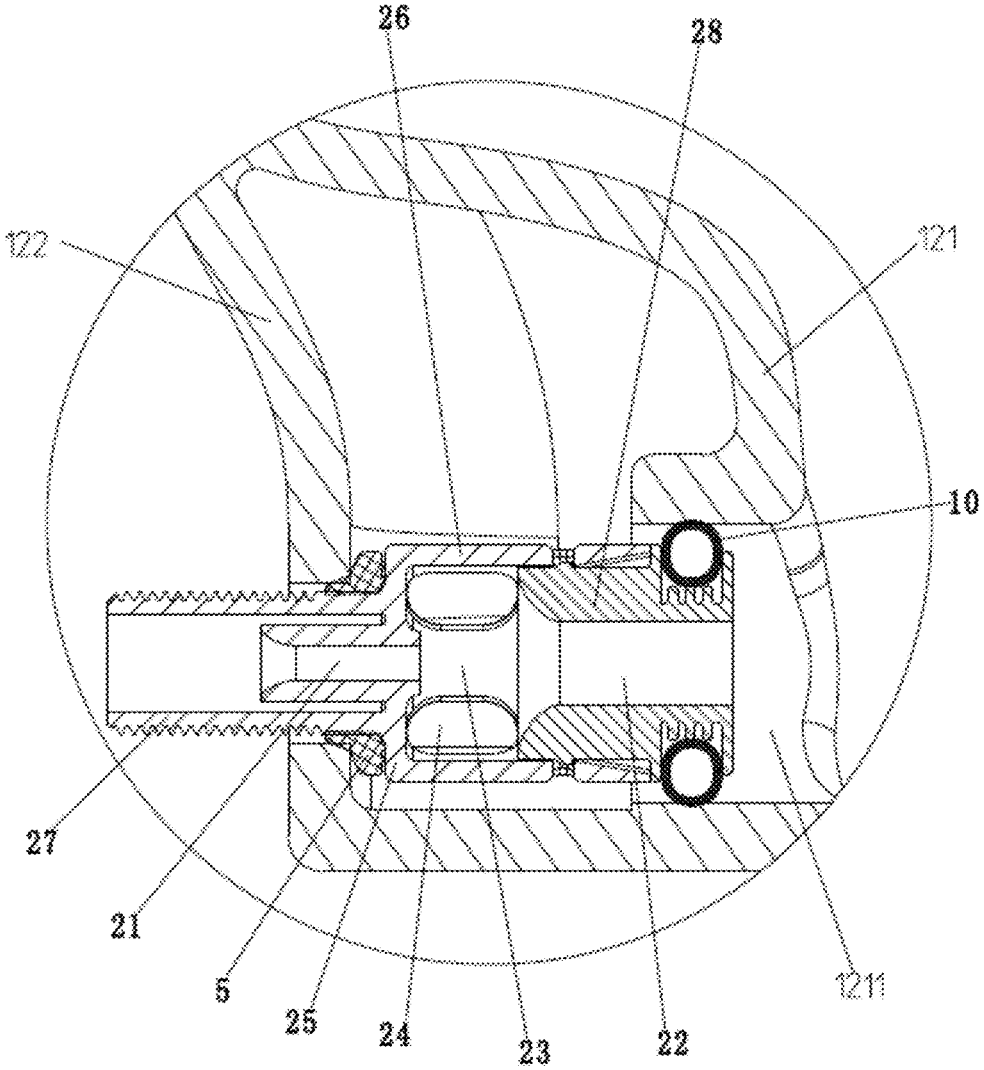
FIG. 16 is a partial enlarged schematic diagram of D in FIG. 15.

The embodiment is substantially the same as the embodiment II, and the difference thereof is as follows:

Referring to FIG. 15 and FIG. 16, in the embodiment, the cross section of the flexible piece 10 is O-shaped, so that the flow increasing device 2 can be flexibly and hermetically matched with the injection hole 1211 through the flexible piece 10 as well.

In the embodiment, structures and principles of other undescribed parts are consistent with those of the embodiment II, which is no longer described in detail here.

Embodiment V

Figure 17:
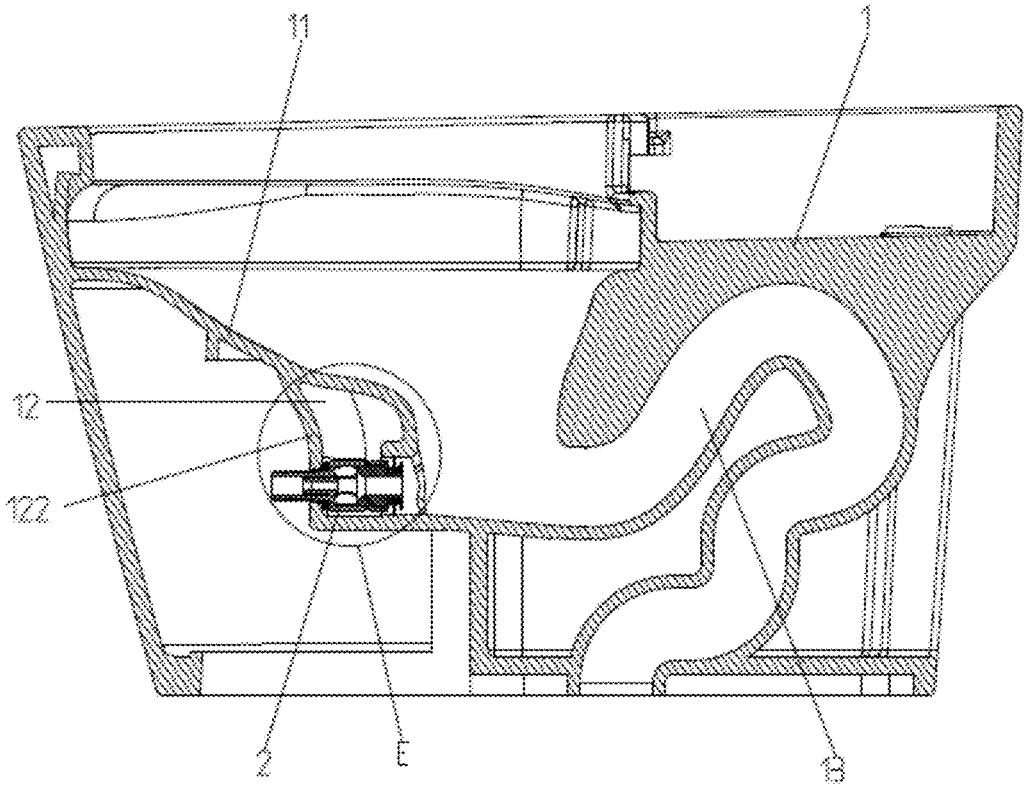
FIG. 17 is a section view of an embodiment V of the present invention (a first nut is hidden in FIG.).
Figure 18:
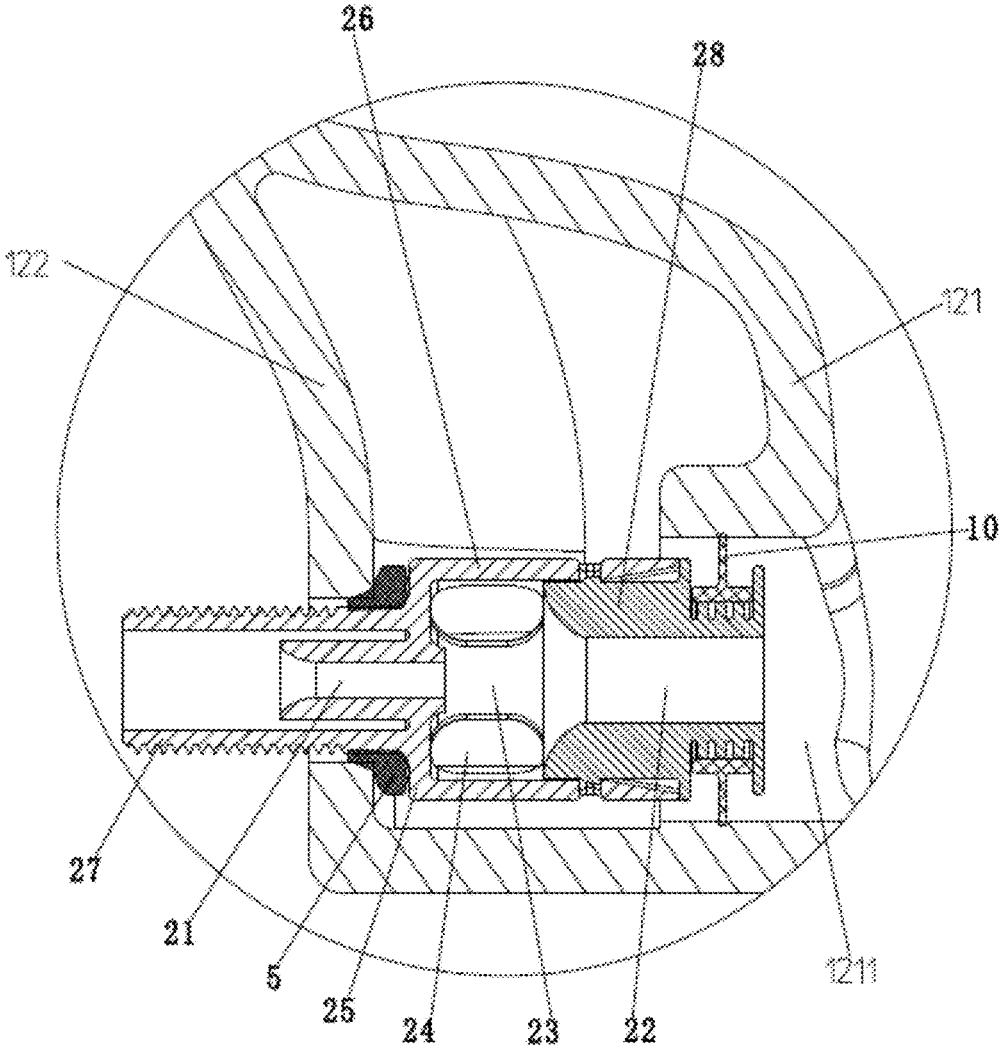
FIG. 18 is a partial enlarged schematic diagram of E in FIG. 17.

The embodiment is substantially the same as the embodiment II, and the difference thereof is as follows:

Referring to FIG. 17 and FIG. 18, in the embodiment, the cross section of the flexible piece 10 is T-shaped, so that the flow increasing device 2 can be flexibly and hermetically matched with the injection hole 1211 through the flexible piece 10 as well.

In the embodiment, structures and principles of other undescribed parts are consistent with those of the embodiment II, which is no longer described in detail here.

Embodiment VI

Figure 19:
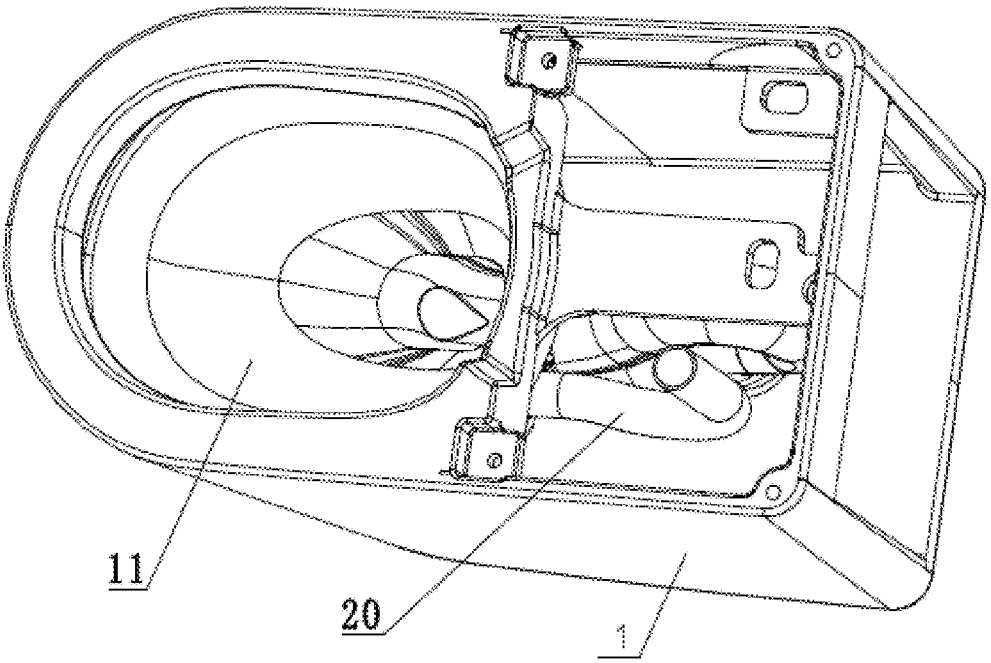
FIG. 19 is a stereo-structure diagram of an embodiment VI of the present invention.
Figure 20:
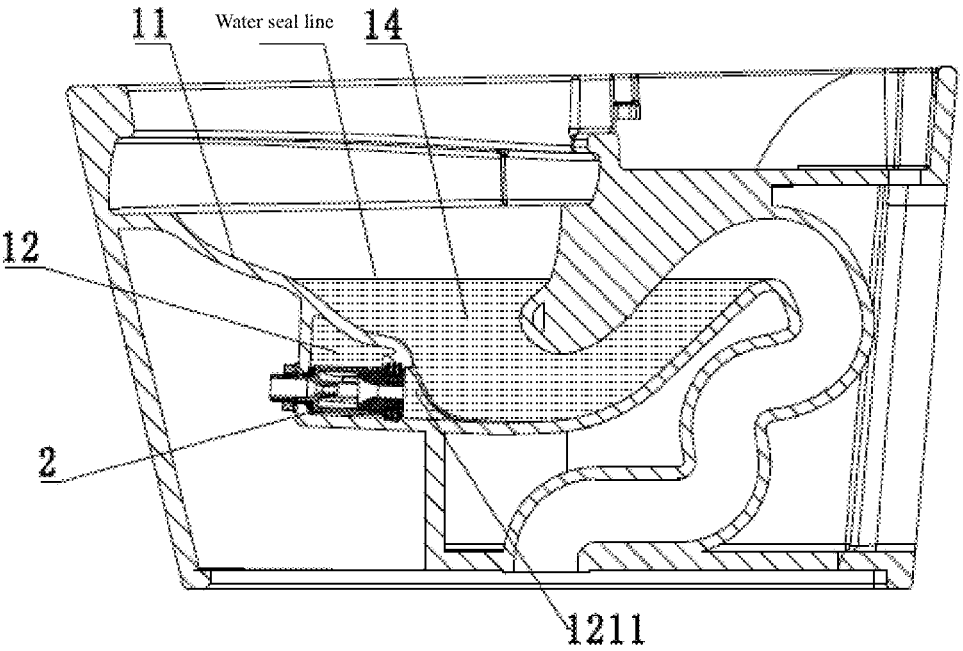
FIG. 20 is a section view I of an embodiment IV of the present invention.
Figure 21:
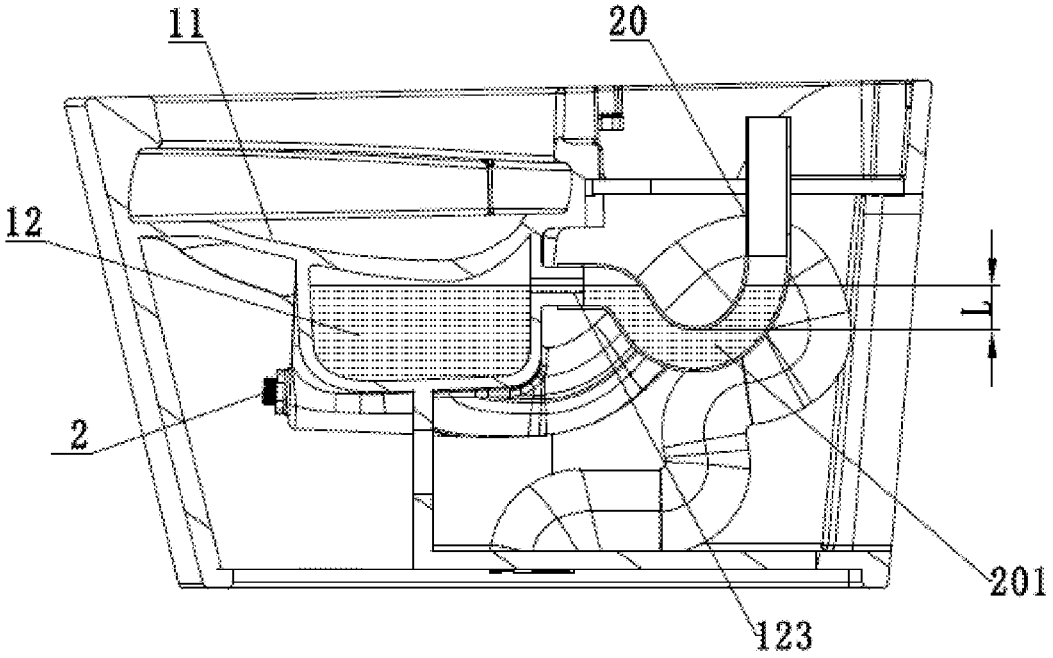
FIG. 21 is a section view II of an embodiment VI of the present invention.

The embodiment is substantially the same as the embodiment II, and the difference thereof is as follows:

Referring to FIG. 19 to FIG. 21, in the embodiment, the closestool flushing system with a flow increasing device further includes an anti-odor pipe 20 (or called as "exhaust pipe", the same in other embodiments), one end of which is communicated with the water storage cavity 12 and the other end of which is communicated with an outer atmosphere, an air vent 123 is formed in the side wall of the water storage cavity 12, the anti-odor pipe 20 is communicated with the air vent 123, a water lock 201 is formed in the anti-odor pipe 20, and saved water of the water lock 201 is respectively communicated with the water storage cavity 12 and the water seal 14, respectively. According to the embodiment, by arranging the anti-odor pipe 20, one end of the anti-odor pipe 20 is communicated with the water storage cavity 12 and the other end thereof is communicated with the outer atmosphere, the water lock 201 is formed in the anti-odor pipe 20, and saved water in the water lock 201 is respectively communicated with the water storage cavity 12 and the water seal 14, so that the water lock 201 can effectively prevent the water storage cavity 12 from discharging odors to indoors, and thus, the usage experience is improved.

Referring to FIG. 21, in the embodiment, a depth of the anti-odor water seal of the water lock 201 is L, and L is preferably greater than or equal to 10 mm. The anti-odor pipe 20 is of a U-shaped structure which forms the water lock 201.

Referring to FIG. 19 to FIG. 21, in the embodiment, the highest position of the air vent 123 is located above the water level of the water storage cavity 12, and the lowest position of the air vent 123 is located below the water level of the water storage cavity 12, so that the water saving water level of the water lock 201 and the water level of the water seal 14 are aligned with the water level of the water storage cavity 12, where the water saving water level of the water lock 201, the water level of the water seal 14 and the water level of the water storage cavity 12 all refer to corresponding water levels of the closestool flushing system in an unflushing state.

During flushing of the closestool flushing system, water in the water storage cavity 12 is sprayed from the injection hole 1211 under the action of the flow increasing device 2 to supplement water to the water seal 14. After the closestool flushing system completes flushing, water flowing to the water seal 14 fills the water storage cavity 12 through the injection hole 1211, so that the water level of the water storage cavity 12 is raised. When the water level of the water storage cavity 12 is raised to the air vent 123, water in the water storage cavity 12 supplements water to the water lock 201. Due to arrangement of the water lock 201, the water storage cavity 12 is isolated from the outer atmosphere in a normal state, and therefore, odors in the water storage cavity 12 are not discharged indoors through the anti-odor pipe 20.

In the embodiment, the anti-odor pipe 20 can be integrally formed with the closestool 1 or the anti-odor pipe 20 is formed independent from the closestool 1.

In the embodiment, structures and principles of other undescribed parts are consistent with those of the embodiment II, which is no longer described in detail here.

Embodiment VII

Figure 22:
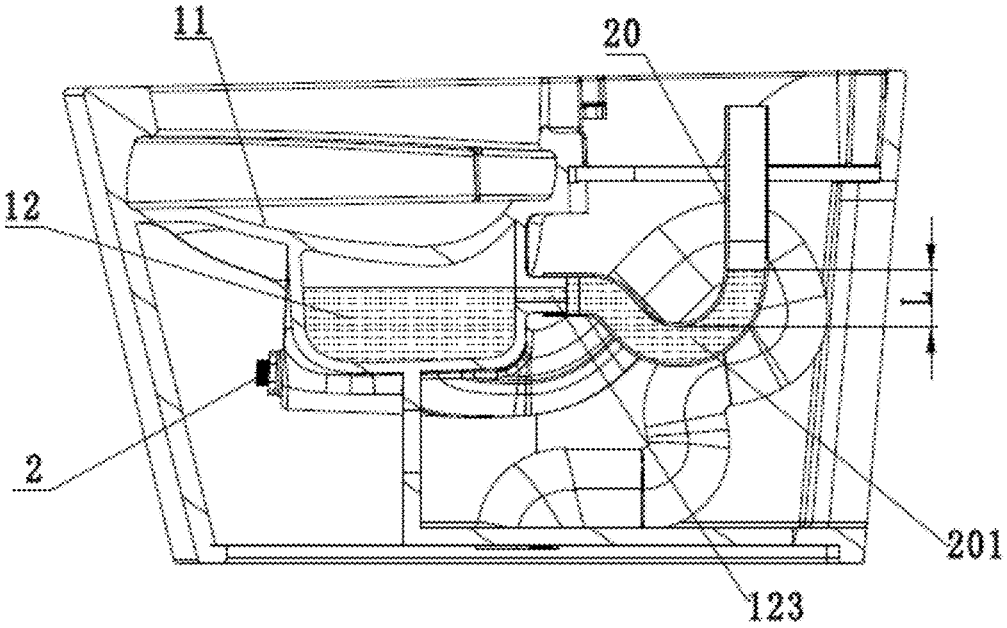
FIG. 22 is a section view of an embodiment VII of the present invention.

The embodiment is substantially the same as the embodiment VI, and the difference thereof is as follows:

Referring to FIG. 22, in the embodiment, in a normal state (i.e., in an unflushing state of the closestool flushing system), the highest position of the air vent 123 is located below the water level of the water seal 14, and the water saving water level of the water lock 201 is higher than the water level of the water storage cavity 12. According to a theory of a communicating vessel, the water saving water level of the water lock 201 will be aligned with the water level of the water seal 14. Specifically, in the embodiment, the highest position of the air vent 123 is aligned with the water level of the water storage cavity 12.

In the embodiment, structures and principles of other undescribed parts are consistent with those of the embodiment VI, which is no longer described in detail here.

Embodiment VIII

Figure 23:
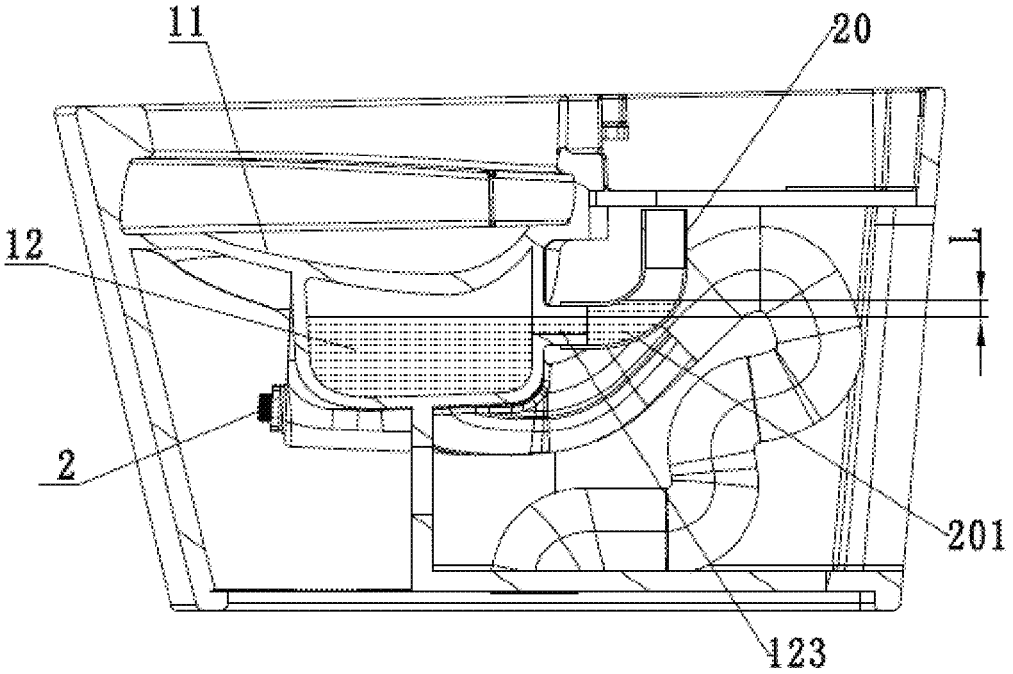
FIG. 23 is a section view of an embodiment VIII of the present invention.

The embodiment is substantially the same as the embodiment VI, and the difference thereof is as follows:

Referring to FIG. 23, in the embodiment, in a normal state (i.e., in an unflushing state of the closestool flushing system), the highest position of the air vent 123 is located below the water level of the water seal 14, and the water saving water level of the water lock 201 is higher than the water level of the water storage cavity 12. According to a theory of a communicating vessel, the water saving water level of the water lock 201 will be aligned with the water level of the water seal 14. Specifically, in the embodiment, the highest position of the air vent 123 is aligned with the water level of the water storage cavity 12. The anti-odor pipe 20 in the embodiment is not of the U-shaped structure but an L-shaped structure which forms the water lock 201.

In the embodiment, structures and principles of other undescribed parts are consistent with those of the embodiment VI, which is no longer described in detail here.

Embodiment VIIII

Figure 24:
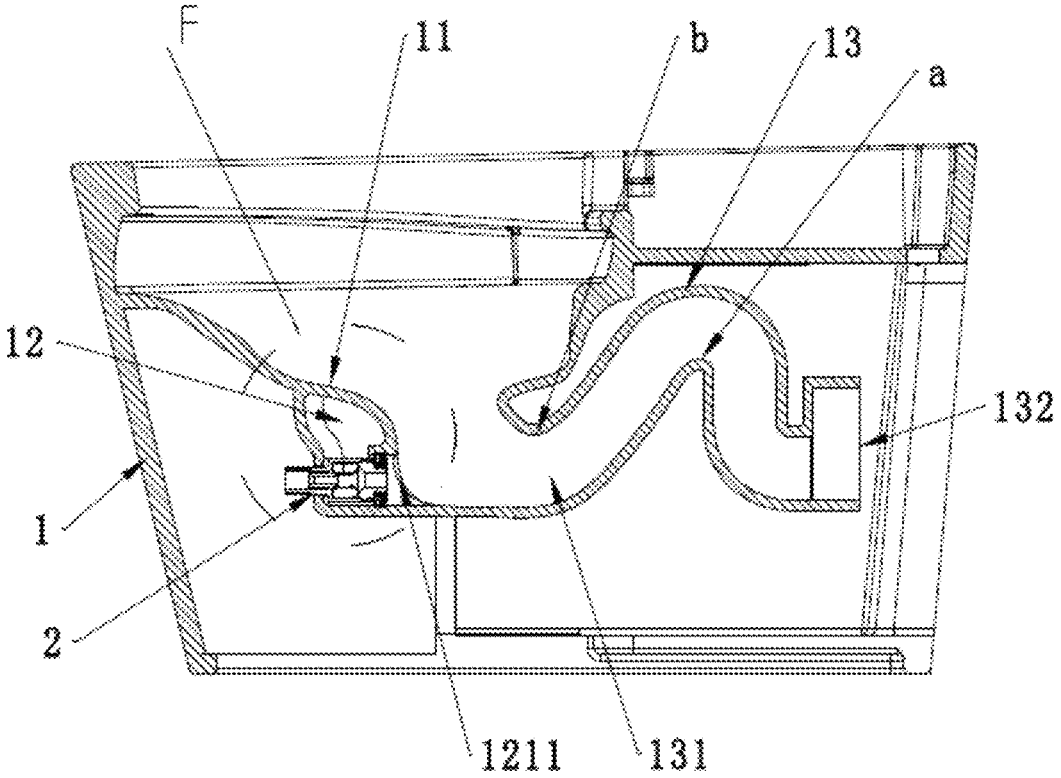
FIG. 24 is a section view I of an embodiment VIIII of the present invention.
Figure 25:
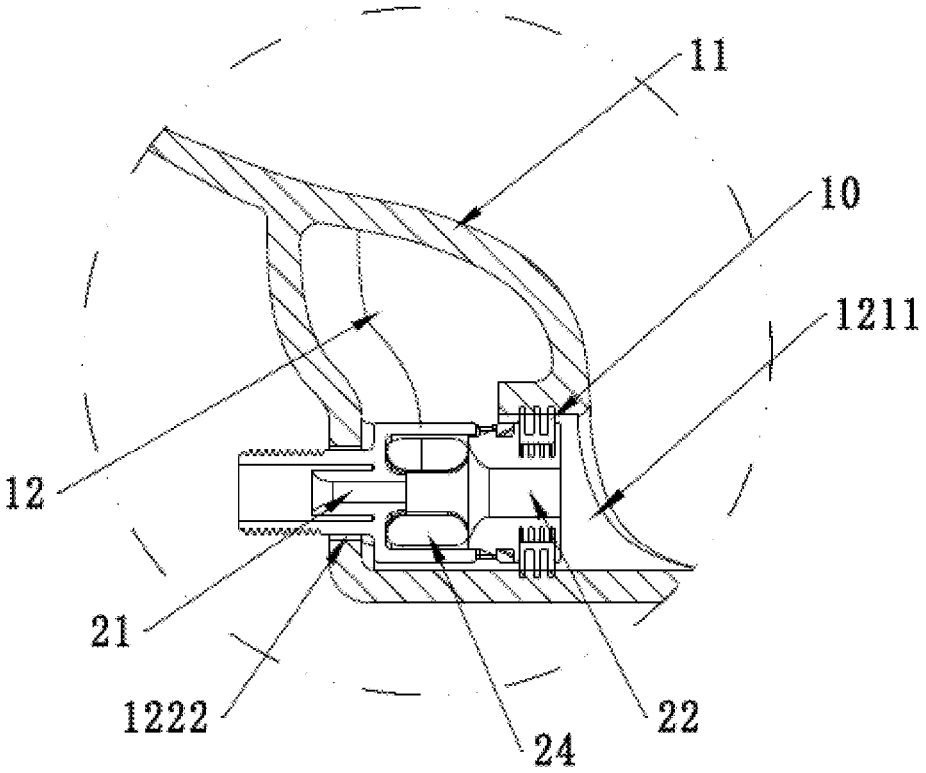
FIG. 25 is a partial enlarged schematic diagram of F in FIG. 24.
Figure 26:
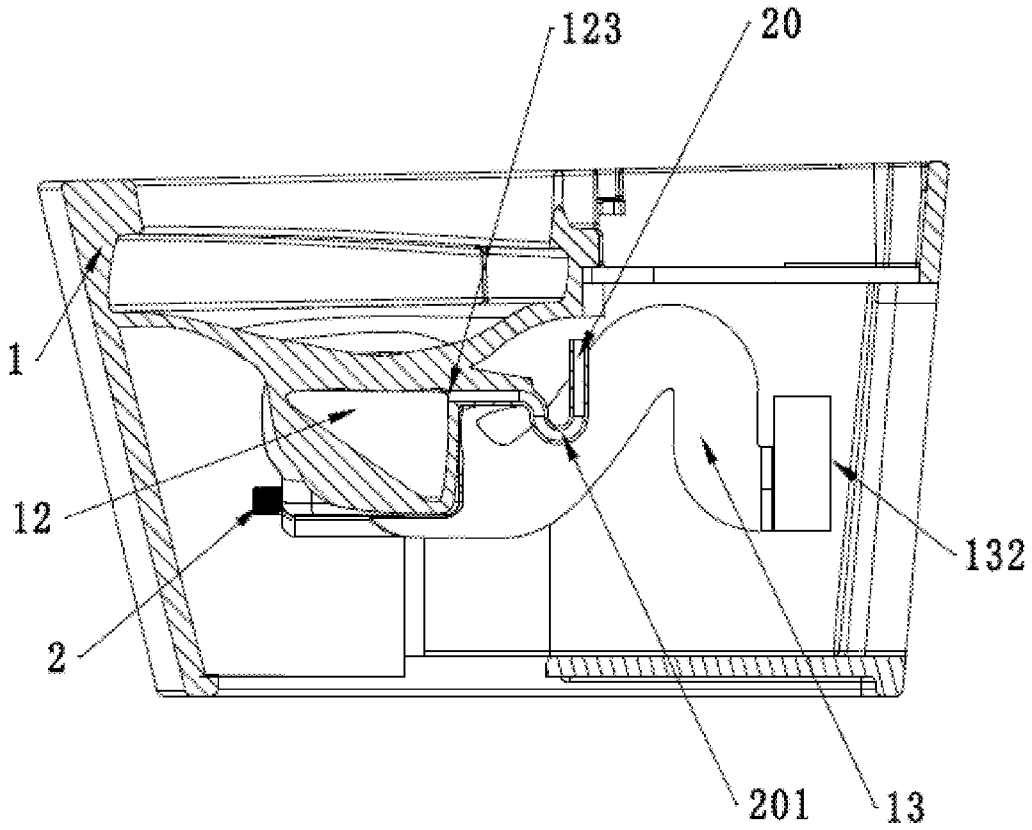
FIG. 26 is a section view II of an embodiment VIIII of the present invention.

The embodiment is substantially the same as the embodiment II, and the difference thereof is as follows:

Referring to FIG. 24 to FIG. 26, the blow-off pipe 13 in the embodiment is a back row type blow-off pipe, an outlet 132 of the back row type blow-off pipe is located on a back portion of the closestool 1 and is arranged backwards, and the injection hole 1211 is arranged opposite an inlet 131 of the back row type blow-off pipe. When a pressure water source provides pressure water to a flow increasing device 2, water in a water storage cavity 12 together with the pressure water is sprayed to the inlet 131 of the back row type blow-off pipe from the injection hole 1211 under the action of the flow increasing device 2, so that the back row type blow-off pipe performs siphoning discharge.

Referring to FIG. 24, in the embodiment, the blow-off pipe 13 is provided with a reversed V-shaped pipe section, and the highest point position a of a bottom wall of the reversed V-shaped pipe section is higher than the highest point position b of the inlet 131 of the back row type blow-off pipe. Of course, in other embodiments, the reversed V-shaped pipe section can further be replaced by a reversed U-shaped pipe section with the same effect.

Referring to FIG. 26, in the embodiment, an air vent 123 is communicated with one end of an anti-odor pipe 20, the other end of the anti-odor pipe 20 is led to the outer atmosphere, and the water lock 201 is formed on the anti-odor pipe 20. According to the embodiment, by arranging the water lock 201, odors in the water storage cavity 12 can be prevented from fleeing to indoors to affect the indoor air quality.

During flushing of the closestool flushing system, water in the water storage cavity 12 is sprayed from the injection hole 1211 under the action of the flow increasing device 2 to supplement water to the water seal. After the closestool flushing system completes flushing, water flowing to the water seal fills the water storage cavity 12 through the injection hole 1211, so that the water level of the water storage cavity 12 is raised. When the water level of the water storage cavity 12 is raised to the air vent 123, water in the water storage cavity 12 supplements water to the water lock 201 till the water level of the water storage cavity 12, the water level of the water seal and the water saving water level of the water lock 201 are aligned. Due to arrangement of the water lock 201, the water storage cavity 12 is isolated from the outer atmosphere in a normal state, and therefore, odors in the water storage cavity 12 are not discharged indoors through the anti-odor pipe 20.

In the embodiment, structures and principles of other undescribed parts are consistent with those of the embodiment II, which is no longer described in detail here.

Embodiment X

The embodiment is substantially the same as the embodiment II, and the difference thereof is as follows:

Referring to FIG. 27 to FIG. 31, in the embodiment, a pressure water source stops supplying water to the flow increasing device 2 prior to decline of a water level of the water storage cavity 12 till the water storage cavity 12 is able to be communicated with an outer atmosphere through the injection hole 1211. According to the embodiment, as the pressure water source is controlled to stop supplying water to the flow increasing device 2 prior to decline of the water level of the water storage cavity 12 till the water storage cavity 12 is able to be communicated with the outer atmosphere through the injection hole 1211 (i.e., prior to decline of the water level of the water storage cavity 12 till the water storage cavity 12 is able to be directly communicated with air in the bottom of the bedpan 11 through the injection hole 1211), so that air in the water storage cavity 12 cannot be directly communicated with the air in the bottom of the bedpan 11 through the injection hole 1211, the air in the water storage cavity 12 can be prevented from being siphoned off into the injection hole 1211, a gas-liquid mixing phenomenon and a dry spray phenomenon are further avoided, and therefore, the noise of a water flow sprayed through the injection hole 1211 is effectively reduced.

Specifically, in the embodiment, the pressure water source stops supplying water to the flow increasing device 2 prior to decline of the water level of the water storage cavity 12 to the top wall of the outlet end of the flow increasing channel 22, so that the pressure water source is controlled to stop supplying water to the flow increasing device 2 prior to decline of the water level of the water storage cavity 12 till the water storage cavity 12 is able to be communicated with the outer atmosphere through the injection hole 1211 (i.e., prior to decline of the water level of the water storage cavity 12 till the water storage cavity 12 is able to be directly communicated with air in the bottom of the bedpan 11 through the injection hole 1211), and air in the water storage cavity 12 can be isolated from air in the bottom of the bedpan 11 directly through the flow increasing channel 22, so that air in the water storage cavity 12 cannot be directly communicated with the air in the bottom of the bedpan 11 through the injection hole 1211, the air in the water storage cavity 12 can be prevented from being siphoned off into the injection hole 1211, a gas-liquid mixing phenomenon and a dry spray phenomenon are further avoided, and therefore, the noise of a water flow sprayed through the injection hole 1211 is effectively reduced.

Referring to FIG. 27 to FIG. 31, in the embodiment, the pressure water source includes a water tank 30 and a water pump 40, where an inlet of the water pump 40 is communicated with the water tank 30, an outlet of the water pump 40 is communicated with an inlet end (an inlet of the flow increasing device 2) of the injection channel 21, and the water pump 40 is used for pumping water in the water tank 30 to the flow increasing device 2. According to the embodiment, water in the water tank 30 is pumped and fed to the flow increasing device 2 by utilizing the water pump 40. As the water flow pumped by the water pump 40 from the water tank 30 is relatively stable and easy to control, the flow increasing effect of the flow increasing device 2 is more stable and the flow increasing time is controllable. Furthermore, the flushing effect of the closestool 1 is stable and the flushing force is guaranteed, and the flushing performance of the closestool 1 can be further improved.

Referring to FIG. 27 to FIG. 31, in the embodiment, the closestool 1 is provided with a cleaning pipeline 50 for flushing a flushing surface (not marked in FIGS.) of the bedpan 11 and further includes a switching valve 60 for switching water supply to the cleaning pipeline 50 and the flow increasing device 2, and an outlet of the water pump 40 is in switching communication with the inlet of the flow increasing device 2 and the cleaning pipeline 50 through the switching valve 60; the water pump 40 controls the switching valve 60 to be switched to supply water to the flow increasing device 2 after being started and controlling the switching valve 60 to be switched to a water supply preset time of the cleaning pipeline 50; the water pump 40 stops supplying water to the flow increasing device 2 prior to decline of the water level of the water storage cavity 12 till the water storage cavity 12 is able to be communicated with the outer atmosphere through the injection hole 1211; after the water pump 40 stops water supply to the flow increasing device 2, the switching valve 60 is re-switched to supply water to the cleaning pipeline 50 so as to supplement water to the water seal 14 in the bottom of the bedpan 11, and water flowing to the water seal 14 in the bottom of the bedpan 11 fills the water storage cavity 12.

Specifically, in the embodiment, the closestool flushing system with a flow increasing device further includes a control unit (not shown in FIGS.), where the control unit is electrically connected with the water pump 40 and the switching valve 60, respectively, the water pump 40 is controlled by the control unit to be started/stopped, and the switching valve 60 is controlled to switch water supply to the cleaning pipeline 50 and the flow increasing device 2. The outlet of the water pump 40 is communicated with the inlet of the switching valve 60 through a pipeline, the switching valve 60 is provided with two outlets, one of the outlets of the switching valve 60 is communicated with the inlet of the cleaning pipeline 50, the other one of the outlets of the switching valve 60 is communicated with the inlet (i.e., the inlet of the injection channel 21) of the flow increasing device 2 through a main flushing pipeline 70, and the outlet end of the cleaning pipeline 50 is provided with a cleaning nozzle assembly 80.

Figure 27:
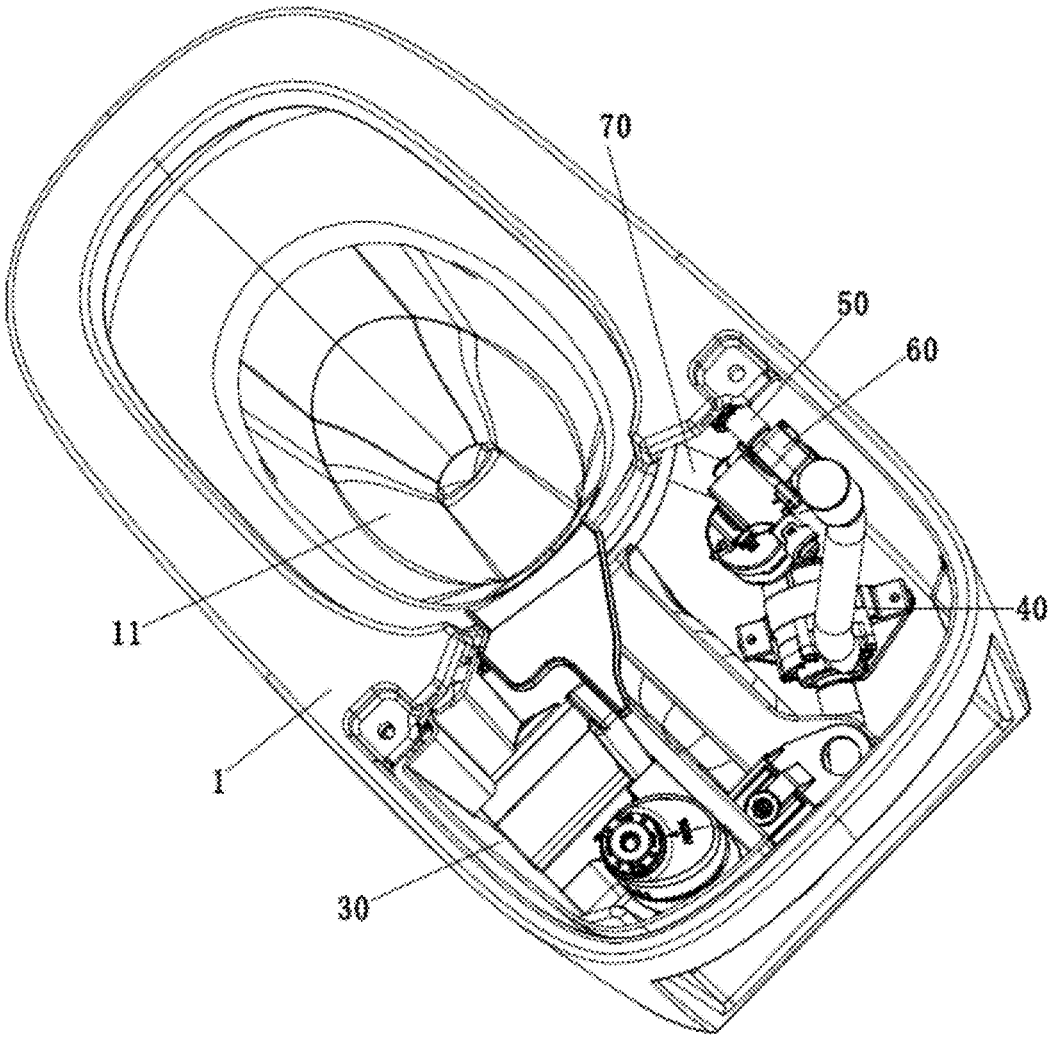
FIG. 27 is a stereogram of an embodiment X of the present invention.
Figure 28:
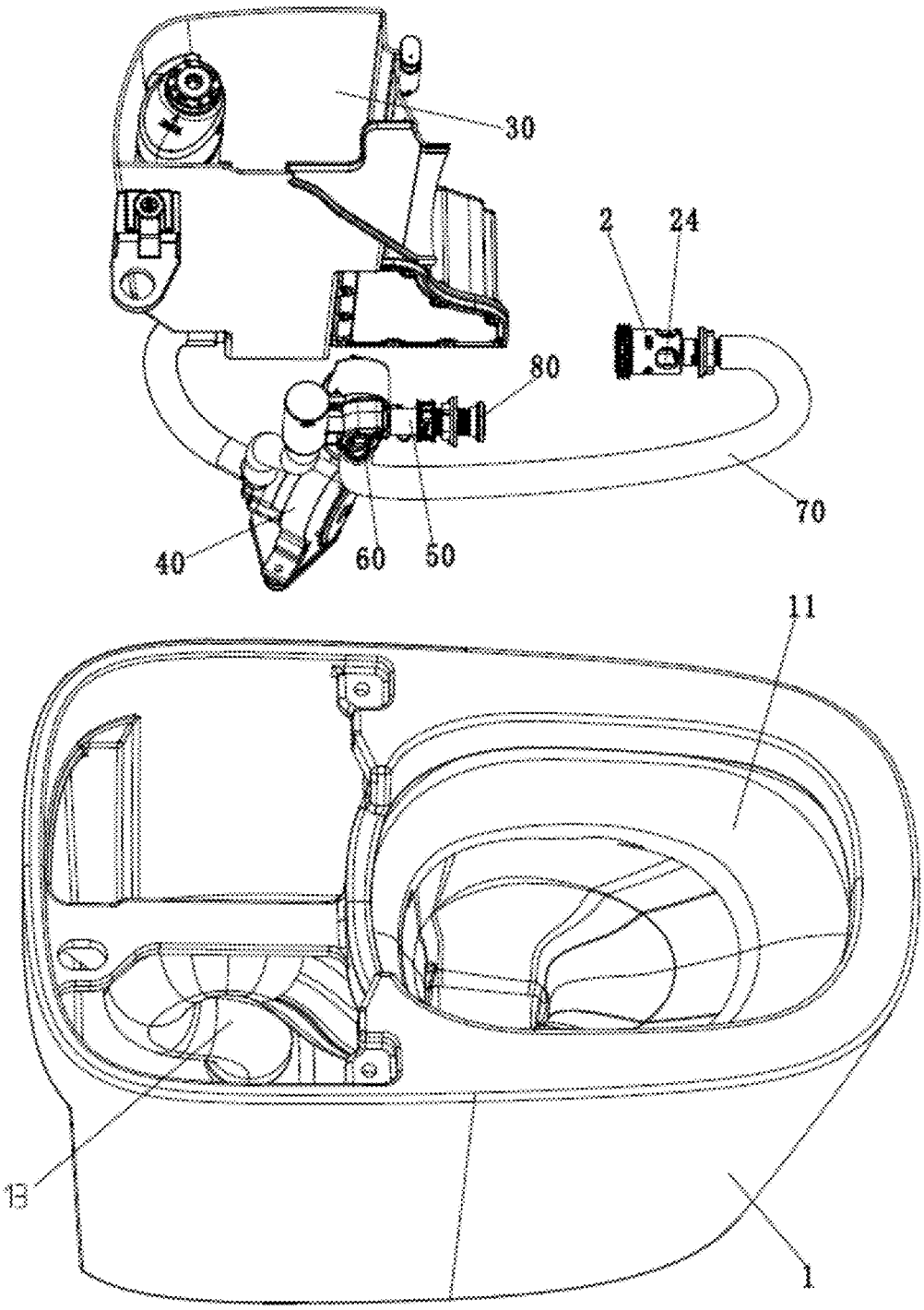
FIG. 28 is a schematic diagram of a breakdown structure of an embodiment X of the present invention.

Referring to FIG. 27 and FIG. 28, in the embodiment, the water tank 30 is arranged on a back portion of the closestool 1, the water pump 40 is arranged outside the water tank 30, and the inlet of the water pump 40 is communicated with the outlet of the water tank 30 through a pipeline. Of course, in other embodiments, the water pump 40 can further be arranged in the water tank 30, and the inlet of the water pump 40 is directly communicated with the inner side of the water tank 30.

Figure 29:
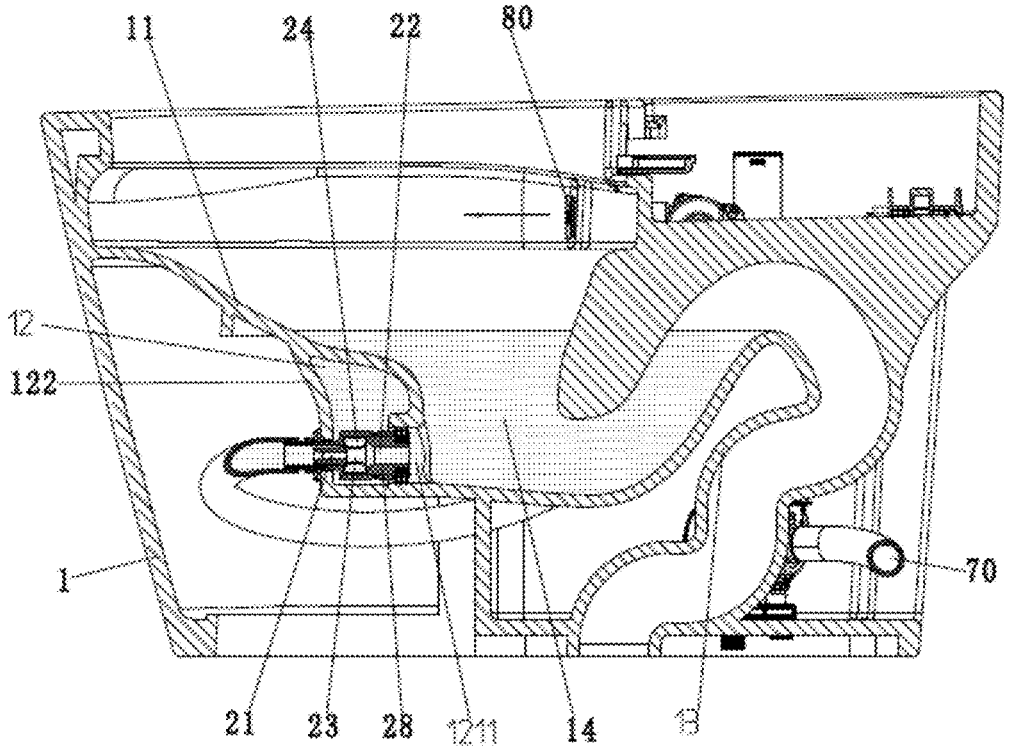
FIG. 29 is a schematic diagram of a section view state of an embodiment X of the present invention.

The working principle of the embodiment is briefly described as follows:

In a normal state, as shown in FIG. 29, the water level of the water storage cavity 12 is aligned with the water level of the water seal 14 *n* the bottom of the bedpan 11, the water pump 40 is not started, and the water tank 30 and the water storage cavity 12 both store water.

Figure 30:
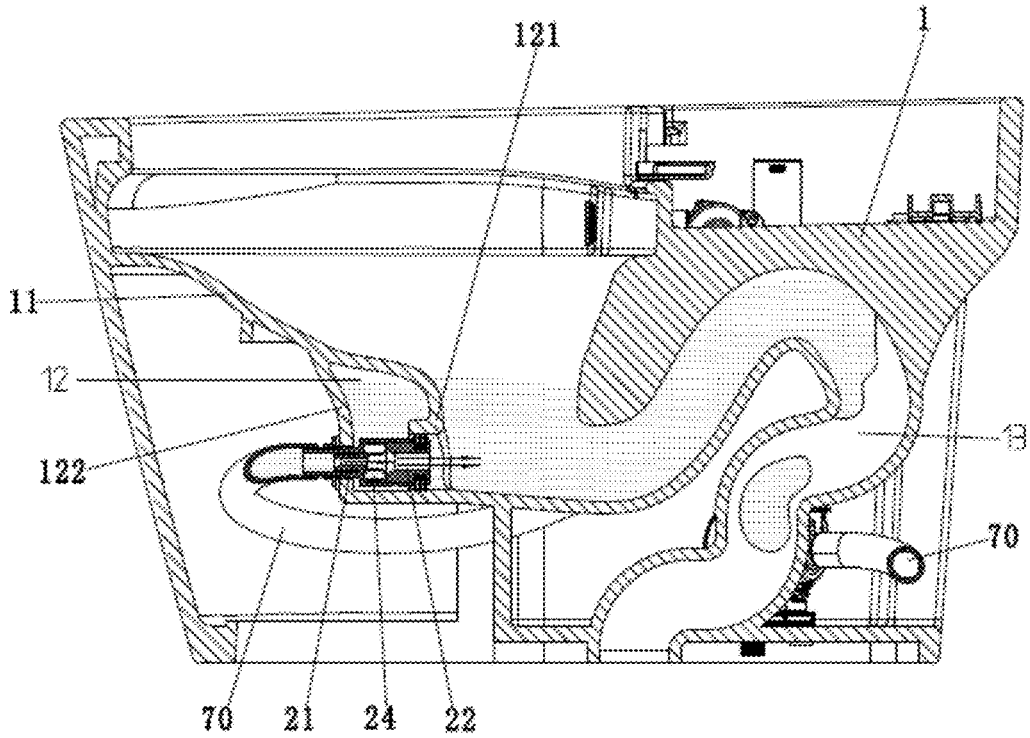
FIG. 30 is a schematic diagram of a section view state of a water pump of an embodiment X of the present invention when the water pump is started and a drain-off pipe starts to form siphoning.
Figure 31:
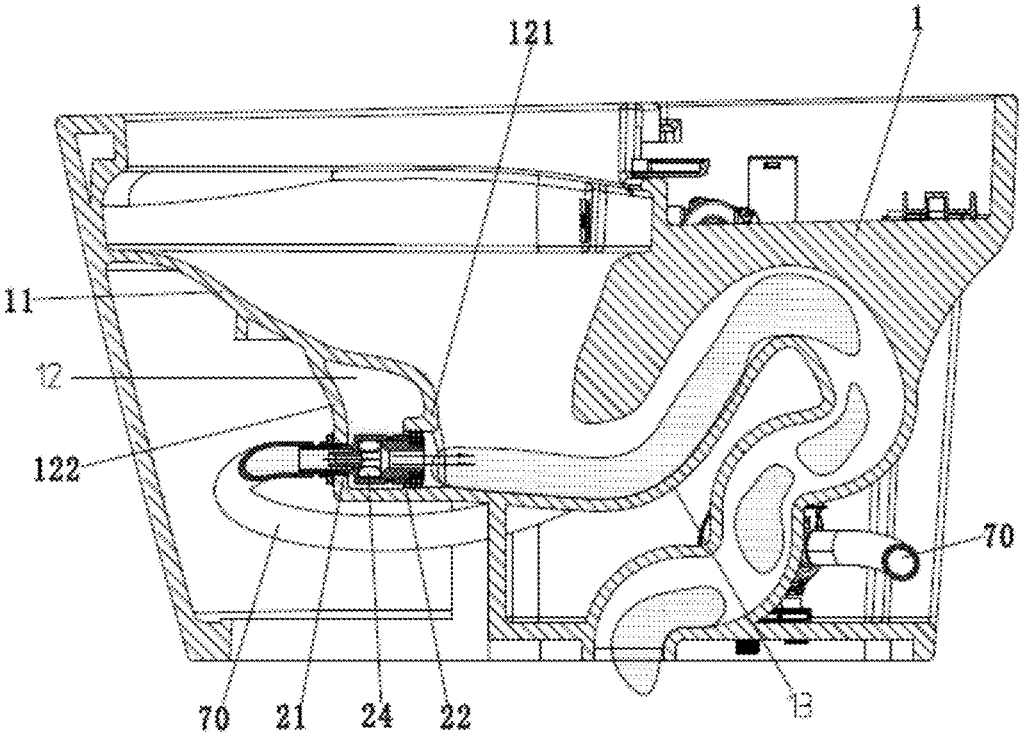
FIG. 31 is a schematic diagram of a section view state of a water pump about to stop of an embodiment X of the present invention.

During flushing, the control unit controls the water pump 40 to start, and controls the switching valve 60 to be switched to supply water to the cleaning pipeline 50 as well so as to clean the flushing surface of the bedpan 11. After the switching valve 60 supplies water to the cleaning pipeline 50 for a preset time, the control unit controls the switching valve 60 to be switched to supply water to the flow increasing device 2, so as to control the pressure water source to provide pressure water to the flow increasing device 2. As shown in FIG. 30 (an arrow in the FIG. represents a water flow direction), pressure water supplied by the water pump 40 to the flow increasing device 2 is sprayed to the flow increasing channel 22 from the injection channel 21 to generate a negative pressure at the flow increasing gap 23, so that water in the water storage cavity 12 is siphoned off into the flow increasing gap 23 through the flow increasing hole 24, and meanwhile, air enters the water storage cavity 12 through the air vent 123, water siphoned off into the flow increasing gap 23 together with water sprayed by the injection channel 21 is sprayed through the flow increasing channel 22, so that the flushing force of the water sprayed by the flow increasing channel 22 is improved. Moreover, the flow increasing channel 22 sprays water toward the inlet of the blow-off pipe 13 to generate a negative pressure at the inlet of the blow-off pipe 13 so as to siphon off water in the water seal 14 in the bottom of the bedpan 11 into the inlet of the blow-off pipe 13. Water in the water seal 14 siphoned off into the inlet of the blow-off pipe 13 together with water sprayed by the flow increasing channel 22 is discharged from the blow-off pipe 13. As a result of further flow increase and amplification, a full-pipe-like state needed by siphoning is achieved rapidly in the blow-off pipe 13 and the blow-off pipe 13 generates siphoning rapidly. As shown in FIG. 31, dirt is discharged out of the closestool 1 rapidly under a thrust of the flow increasing device 2 and a siphoning force of the blow-off pipe 13. The water pump 40 stops supplying water to the flow increasing device 2 prior to decline of the water level of the water storage cavity 12 to the top wall of the outlet end of the flow increasing channel 22, the control unit controls the switching valve 60 to be re-switched to supply water to the cleaning pipeline 50 so as to supplement water to the water seal 14 in the bottom of the bedpan 11, and water flowing to the water seal 14 in the bottom of the bedpan 11 fills the water storage cavity 12. Air in the water storage cavity 12 is discharged through the air vent 123, and meanwhile, a water inlet valve (not marked in FIG.) of the water tank 30 is controlled to supplement water to the water tank 30, and then the water pump 40 is stopped and recovered to the normal state.

In the embodiment, structures and principles of other undescribed parts are consistent with those of the embodiment II, which is no longer described in detail here.

In other embodiments, it can also be structured that the flow increasing device is arranged in the injection hole in a penetrating manner, and there is a gap between the flow increasing device and the hole wall of the injection hole, the gap being preferably smaller than 2 mm. In the gap range, water in the water storage cavity can be better sprayed to the water seal in the bottom of the bedpan through the injection hole, the flow increasing device can also be better mounted and fixed, and meanwhile, dirt in the water seal can also be better prevented from entering the water storage cavity from the gap between the hole of the injection hole and the flow increasing device. Further, the pressure water source stops supplying water to the flow increasing device prior to decline of the water level of the water storage cavity to the top wall of the injection hole, so that the pressure water source is controlled to stop supplying water to the flow increasing device prior to decline of the water level of the water storage cavity till the water storage cavity is communicated with the outer atmosphere through the injection hole (i.e., prior to decline of the water level of the water storage cavity till the water storage cavity is directly communicated with air in the bottom of the bedpan through the injection hole), air in the water storage cavity can be isolated from air in the bottom of the bedpan through water in the flow increasing channel and water between the flow increasing device and the hole wall of the injection hole, so that air in the water storage cavity cannot be directly communicated with air in the bottom of the bedpan through the gap between the flow increasing channel or the flow increasing device and the hole wall of the injection hole, air in the water storage cavity can be prevented from being siphoned off into the gap between the flow increasing channel or the flow increasing device and the hole wall of the injection hole, a gas-liquid mixing phenomenon and a dry spray phenomenon are further avoided, and therefore, the noise of a water flow sprayed by the flow increasing device through the injection hole is effectively reduced.

In other embodiments, the pressure water source can further be municipal tap water. A pipeline between the flow increasing device and the pressure water pump is provided with a control valve, the control valve can be an electromagnetic valve or a mechanical valve, the pressure water source is controlled to be connected or disconnected with the flow increasing device by the control valve, and the pressure water source is conveniently controlled by the control valve to provide pressure water to the flow increasing device or to stop supplying water to the flow increasing device.

It can be known from the above-mentioned description of the present invention that compared with the prior art, by forming a water storage cavity in the bottom of the bedpan and then arranging a flow increasing device in the water storage cavity, water in the water storage cavity is siphoned off into the flow increasing device through a flow increasing gap by means of a Venturi principle, water siphoned off into the flow increasing device together with water injected by the injection channel is injected to a water seal in the bottom of the bedpan from the injection hole through the injection channel, and the flow increasing device has a better flow increasing effect and flow increasing stability, so that water in the water storage cavity is capable of flowing stably to the water seal in the bottom of the bedpan as soon as possible so as to supplement water to the water seal, and therefore, the flushing performance of the closestool is improved, the lowest using pressure of a current pressure type flushing system can be reduced, the noise of the closestool can be reduced, and a splashing phenomenon can be avoided.

The above-mentioned embodiments are merely used for further description of a closestool flushing system with a flow increasing device of the present invention, but the present invention is not limited to the embodiments. Any subtle modifications, equivalent changes and modifications made on the embodiments in accordance with the technical substance of the present invention shall come within the scope of the technical solution of the present invention.

What is claimed is:

1. A closestool flushing system with a flow increasing device, comprising:

a closestool provided with a bedpan, wherein the bottom of the bedpan is provided with water seal water for forming a water seal, the bottom of the bedpan is provided with a water storage cavity that is provided with a front cavity wall and a back cavity wall arranged opposite each other, the front cavity wall is provided with an injection hole, a back cavity wall is provided with a mounting hole, and the water storage cavity is communicated with the water seal through the injection hole; and a flow increasing device mounted in the mounting hole, wherein the flow increasing device is provided with an injection channel and a flow increasing channel, a cross-sectional area of an inlet end of the flow increasing channel is larger than that of an outlet end of the injection channel, the inlet end of the injection channel is communicated with a pressure water source that provides pressure water, water at the outlet end of the injection channel is sprayed to the inlet end of the flow increasing channel, a flow increasing gap communicated with the water storage cavity is formed between the outlet end of the injection channel and the inlet end of the flow increasing channel, and water in the flow increasing channel is sprayed to the water seal through the injection hole, wherein the flow increasing device is further hermetically arranged in the injection hole in a penetrating manner, or the flow increasing device is further arranged in the injection hole in a penetrating manner and there is a flow passage gap between the flow increasing device and a hole wall of the injection hole.

2. The closestool flushing system with a flow increasing device according to claim 1, wherein the flow increasing device comprises an outer sleeve for connecting the injection channel with the flow increasing channel, the outlet end of the injection channel and the inlet end of the flow increasing channel are located in the outer sleeve, a side wall of the outer sleeve is provided with a penetrative flow increasing hole, and the flow increasing gap is communicated with the water storage cavity through the flow increasing hole.

3. The closestool flushing system with a flow increasing device according to claim 2, wherein the flow increasing device comprises an injection main body and a flow increasing main body connected together through a connecting structure, the injection channel and the outer sleeve both are arranged on the injection main body, and the flow increasing channel is arranged on the flow increasing main body.

4. The closestool flushing system with a flow increasing device according to claim 1, wherein the flow increasing device is hermetically arranged in the mounting hole in a penetrating manner and further comprises a first nut, the flow increasing device is provided with a first limiting portion, and an end of the flow increasing device stretching out of the water storage cavity from the mounting hole is in screw joint with the first nut, so that the first limiting portion further presses against an inner side of the back cavity wall or an outer side of the front cavity wall while the first nut presses against an outer side of the back cavity wall.

5. The closestool flushing system with a flow increasing device according to claim 1, wherein the pressure water source stops supplying water to the flow increasing device prior to decline of a water level of the water storage cavity till the water storage cavity is able to be communicated with an outer atmosphere through the injection hole; and the water storage cavity is provided with an air vent and is communicated with the outer atmosphere through the air vent.

6. The closestool flushing system with a flow increasing device according to claim 5, wherein the pressure water source comprises a water tank and a water pump, an inlet of the water pump is communicated with the water tank, an outlet of the water pump is communicated with the inlet end of the injection channel, and the water pump is used for pumping water in the water tank to the flow increasing device; or the pressure water source is municipal tap water, a pipeline between the flow increasing device and the pressure water source is provided with a control valve, and the pressure water source is controlled to be connected with or disconnected with the flow increasing device through the control valve.

7. The closestool flushing system with a flow increasing device according to claim 6, wherein the closestool is provided with a cleaning pipeline for flushing a flushing surface of the bedpan and further comprises a switching valve for switching water supply to the cleaning pipeline and the flow increasing device, and an outlet of the water pump is in switching communication with the inlet of the flow increasing device and the cleaning pipeline through the switching valve; the switching valve be controlled to switch to supply water to the flow increasing device after the water pump being started and the switching valve be controlled to switch to a water supply preset time of the cleaning pipeline; after the pressure water supply stops water supply to the flow increasing device, the switching valve is re-switched to supply water to the cleaning pipeline so as to supplement water to the water seal.

8. The closestool flushing system with a flow increasing device according to claim 1, wherein the flow increasing device is hermetically matched with the injection hole through a sealing corrugated pad, the sealing corrugated pad is sleeved outside the flow increasing device and is located between the flow increasing device and the hole wall of the injection hole; or the flow increasing device is hermetically matched with the injection hole through a first sealing pad, the first sealing pad is sleeved outside the flow increasing device, and the flow increasing device presses the first sealing pad against the outer side or the inner side of the front cavity wall.

9. The closestool flushing system with a flow increasing device according to claim 1, wherein the bottom of the bedpan is further provided with a first blow-off pipe, an outlet of the flow increasing device is arranged opposite an inlet of the blow-off pipe, and the cross area of the outlet of the flow increasing device is smaller than that of the inlet of the blow-off pipe.

10. The closestool flushing system with a flow increasing device according to claim 1, wherein the flow increasing device is fixedly mounted in the injection hole and is hermetically and fixedly mounted in the mounting hole, the side wall of the flow increasing device is provided with a flow increasing hole communicated with the water storage cavity, and the flow increasing gap is communicated with the water storage cavity through the flow increasing hole.

11. The closestool flushing system with a flow increasing device according to claim 1, further comprising a pre-locking sleeve and a second nut, wherein the pre-locking sleeve is hermetically fixed in the mounting hole, the flow increasing device is sleeved in the pre-locking sleeve and is hermetically matched with the pre-locking sleeve, and the second nut is in screw joint with an end of the pre-locking sleeve located outside the water storage cavity and presses the flow increasing device against the inner side of the front cavity wall or the pre-locking sleeve.

12. The closestool flushing system with a flow increasing device according to claim 11, further comprising a third nut, wherein the pre-locking sleeve is arranged in the mounting hole in a penetrating manner and an end of the pre-locking sleeve located in the water storage cavity is provided with a second limiting portion, and the third nut is in screw joint with a portion of the pre-locking sleeve stretching out of the water storage cavity, so that the back cavity wall is clamped between the third nut and the second limiting portion; or, the pre-locking sleeve and the back cavity wall are of an integrated structure.

13. The closestool flushing system with a flow increasing device according to claim 1, wherein a portion of the injection channel close to the outlet end of the injection channel is provided with a first rectifying straight section, a value range of a diameter D1 of the first rectifying straight section is as follows: D1 is greater than or equal to 3 mm but less than or equal to 8 mm, and a ratio of a length L1 of the first rectifying straight section to the diameter D1 thereof is as follows: L1:D1 is greater than or equal to 2.

14. The closestool flushing system with a flow increasing device according to claim 1, wherein a portion of the flow increasing channel close to the outlet end of the flow increasing channel is provided with a second rectifying straight section, a value range of a diameter D2 of the second rectifying straight section is as follows: D2 is greater than or equal to 8 mm but less than or equal to 25 mm, and a ratio of a length L2 of the second rectifying straight section to the diameter D2 thereof is as follows: L2:D2 is greater than or equal to 2.

15. The closestool flushing system with a flow increasing device according to claim 1, wherein a value range of an axial distance H between the outlet end of the injection channel and the inlet end of the flow increasing channel is as follows: H is greater than or equal to 0 but less than or equal to 85 mm.

16. The closestool flushing system with a flow increasing device according to claim 1, wherein the flow increasing device is fixedly mounted in the injection hole through a flexible piece.

17. The closestool flushing system with a flow increasing device according to claim 16, wherein the flexible piece is arranged outside the flow increasing device and is located between the flow increasing device and the hole wall of the injection hole, is annular or C-shaped, and is sleeved outside the flow increasing device.

18. The closestool flushing system with a flow increasing device according to claim 16, wherein the flow increasing device is hermetically and fixedly mounted in the injection hole and is hermetically matched with the injection hole through the flexible piece, the flexible piece is sleeved outside the flow increasing device and is located between the flow increasing device and the hole wall of the injection hole; or, the flexible piece is in clearance fit with the outer wall of the flow increasing device or is in clearance fit with the hole wall of the injection hole, so that there is a flow passage gap between the outer wall of the flow increasing device and the hole wall of the injection hole.

19. The closestool flushing system with a flow increasing device according to claim 1, wherein the cavity wall of the water storage cavity and the bedpan are of an integrated structure.

20. The closestool flushing system with a flow increasing device according to claim 1, further comprising an anti-odor pipe, wherein one end of the anti-odor pipe is communicated with the water storage cavity and the other end thereof is communicated with the outer atmosphere, a water lock is formed in the anti-odor pipe, and saved water of the water lock is communicated with water of the water storage cavity and the water seal; when the closestool flushing system flushes, the water storage cavity supplements water to the water seal; and after the closestool flushing system completes flushing, water flowing to the water seal fills the water storage cavity.

21. The closestool flushing system with a flow increasing device according to claim 20, wherein the side wall of the water storage cavity is provided with an air vent, and the anti-odor pipe is communicated with the air vent;

the highest position of the air vent is located below the water level of the water seal; or the highest position of the air vent is located above the water level of the water seal, and the lowest position of the air vent is located below the water level of the water storage cavity.

22. The closestool flushing system with a flow increasing device according to claim 1, wherein the closestool is provided with a back row type blow-off pipe capable of forming siphoning, an outlet of the back row type blow-off pipe is located on a back portion of the closestool and is arranged backwards, the injection hole is located below the water level of the water seal, an inlet of the back row type blow-off pipe is communicated with the water seal and is located below the water level of the water seal, and the injection hole is arranged opposite the inlet of the back row type blow-off pipe; when the pressure water source provides the pressure water to the flow increasing device, water in the water storage cavity together with the pressure water is sprayed to the inlet of the back row type blow-off pipe through the injection hole under the action of the flow increasing device, so that the back row type blow-off pipe performs siphoning discharge.

* * * * *